US006609780B2

(12) United States Patent
Sugiyama

(10) Patent No.: US 6,609,780 B2
(45) Date of Patent: Aug. 26, 2003

(54) INK JET PRINTER HAVING A MECHANISM FOR DRIVING WIPER AND PURGE PUMP

(75) Inventor: Wataru Sugiyama, Okazaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/899,912

(22) Filed: Jul. 9, 2001

(65) Prior Publication Data

US 2003/0007031 A1 Jan. 9, 2003

(30) Foreign Application Priority Data

Jul. 6, 2001 (JP) ..... 2001-206246
Jul. 6, 2001 (JP) ..... 2001-206248
Jul. 6, 2001 (JP) ..... 2001-206249
Jul. 6, 2001 (JP) ..... 2001-206250

(51) Int. Cl.[7] ..... B41J 2/165

(52) U.S. Cl. ..... 347/33; 347/23; 347/27; 347/30; 347/85; 347/86

(58) Field of Search ..... 347/23, 27, 30, 347/33, 28, 85

(56) References Cited

U.S. PATENT DOCUMENTS 4,380,770 A 4/1983 Maruyama
5,138,343 A * 8/1992 Aichi et al. ..... 347/30
5,555,461 A * 9/1996 Ackerman ..... 347/33
5,706,038 A * 1/1998 Jackson et al. ..... 347/33
5,717,445 A * 2/1998 Kida et al. ..... 347/33
6,312,093 B1 * 11/2001 Saijo et al. ..... 347/30

FOREIGN PATENT DOCUMENTS

| | | |
|---|---|---|
| EP | 0 916 508 A2 | 5/1999 |
| EP | 0 972 648 A2 | 1/2000 |
| JP | 56-75867 | 6/1981 |
| JP | 8-224889 | 9/1996 |
| JP | 2000-103084 | 4/2000 |

* cited by examiner

*Primary Examiner*—John Barlow
*Assistant Examiner*—Ly T Tran
(74) *Attorney, Agent, or Firm*—Oliff & Berridge, PLC

(57) ABSTRACT

A planetary gear mechanism is assembled into a pump unit frame with an ink supply pump, a buffer purge pump, a suction pump, a motor shaft gear, and a wiper member. The buffer purge pump and the suction pump are configured to be selectively driven by switching rotational direction of a motor having the motor shaft gear. The planetary gear mechanism transmits drive force from the motor shaft gear to the buffer purge pump or the suction pump in accordance with rotational direction. The buffer purge pump and the wiper member are selectively driven by the rotations of the motor rotating in the same direction in phase-dependent on the rotations of the motor.

21 Claims, 32 Drawing Sheets

INK JET PRINTER HAVING A MECHANISM FOR DRIVING WIPER AND PURGE PUMP

BACKGROUND OF THE INVENTION

1. Field of the Invention

The present invention relates to an ink jet printer, and more particularly to a driving mechanism for driving a wiper and a purge pump.

2. Description of the Related Art

There has been known a conventional ink jet head formed with a plurality of ink chambers and a plurality of nozzles in a one-to-one correspondence with the ink chambers. The condition of ink in the nozzles and the ink chambers can degrade over time when dust mixes in the ink, when the solvent of the ink evaporates, or for other reasons. This degradation of ink condition can result in a portion of the nozzles ejecting ink improperly.

Ink jet printers including such an ink jet head have recently been provided with recovery mechanisms for returning the poor condition of ink in nozzles to a good condition. Such recovery mechanisms include wiper devices and suction purge devices. The wiper devices wipe the nozzle surface of the ink jet head. The suction purge devices cover the nozzle surface with a suction cap and operate a suction pump to suck ink from the nozzles through the suction cap.

U.S. Pat. No. 4,380,770 to Maruyama discloses an ink jet printer including pumped-forced circulation of ink through the head and the suction cap which together eliminate gas from the ink supply and overcome ink stagnation which adversely affect printing quality. This printer requires a pump for producing the forceful ink flow.

However, an ink jet printer with a recovery mechanism must include drive mechanisms for driving the different devices of the recovery mechanism. For example, a drive mechanism is required for driving the wiper device and motors are required for driving the suction purge device and the ink flow pump. All of these drive mechanisms undesirably increase the size and production cost of the ink jet printer.

Also, if a single motor is shared to drive more than one of the devices, the timing for driving one device is restricted by the timing for driving the other devices. The devices cannot be efficiently operated, so that the print cycle time increases. This prevents increasing the printing speed.

SUMMARY OF THE INVENTION

It is an object of the present invention to overcome the above-described problems, and provide a printing device capable of preventing ink ejection problems without increasing the size of the printer.

To achieve the above and other objects, there is provided an ink jet printer that has a basic structure including a printer body, a head unit, a pump, a wiper member, a motor, and a drive mechanism. The head unit is detachably mounted on the printer body and has an ink head formed with a plurality of ink chambers. The ink head has a nozzle surface formed with a plurality of nozzles fluidly connected to respective ones of the plurality of ink chambers individually. The pump is provided for adjusting an ink condition in the ink head. The wiper member is provided for wiping the nozzle surface of the ink head. The drive mechanism operatively connects the motor to the pump and the wiper member. The pump and the wiper member are driven in phase-dependent on rotations of the motor rotating in a predetermined direction.

The drive mechanism can include a transmission gear for transmitting driving force of the motor, a first gear rotatably disposed to meshingly engage the transmission gear, and a second gear rotatably disposed to meshingly engage the transmission gear. The first gear is formed with a cam groove for driving the wiper member. Rotations of the second gear drives the pump.

An adjustment mechanism can further be provided for adjusting rotational timings of the first gear and the second gear. The first gear and the second gear have a diameter equal to each other and are in concentric with each other. Each of the first gear and the second gear has a non-geared portion. The adjustment mechanism may include a first abutment portion formed in the first gear and a second abutment portion formed in the second gear. When the first abutment portion and the second abutment portion are in abutment with each other while one of the first gear and the second gear is stopped and remaining one of the first gear and the second gear is rotated, the one of the first gear and the second gear is urged by and rotated with the remaining one of the first gear and the second gear. The first abutment portion and the second abutment portion are brought into abutment with each other while the non-geared portion of one of the first gear and the second gear faces the transmission gear with the one of the first gear and the second gear being stopped, the one of the first gear and the second gear is urged by and rotated with the remaining one of the first gear and the second gear. The first abutment portion and the second abutment portion are brought into non-abutment with each other when the non-geared portion of the remaining one of the first gear and the second gear faces the transmission gear.

With respect to the basic structure, there can further be provided an ink supply source storing ink, a first ink channel for supplying the ink in the ink supply source to the head unit, and a second ink channel for feeding back ink in the head unit to the ink supply source. The pump is disposed in the second ink channel and generates a flow of ink from the head unit to the ink supply source when driven and interrupts the flow of ink when stopped.

It is desirable to stop the pump when ink droplets are elected from any one of the plurality of nozzles.

The ink supply source may include an ink cartridge detachably mounted on the ink jet printer body, a third ink channel, and a sub-tank fluidly connected to the ink cartridge through the third ink channel. The sub-tank stores ink supplied from the ink cartridge. In this configuration, an ink supply pump may further be provided. The ink supply pump is disposed in the third ink channel and generates a flow of ink from the ink cartridge to the sub-tank when driven and interrupts the flow of ink when stopped. The first ink channel supplies the ink of the sub-tank to the head unit, and the second ink channel feeds back the ink stored in the head unit to the sub-tank.

It is desirable that the pump be not driven during wiping operation of the wiper member.

With respect to the basic structure, there may further be provided a suction cap movable toward the head unit to hermetically seal the plurality of nozzles. The pump is fluidly connected to the suction cap. The pump sucks ink in the plurality of ink chambers through the suction cap. It is desirable that the pump be stopped when the pump sucks ink in the plurality of ink chambers through the suction cap.

BRIEF DESCRIPTION OF THE DRAWINGS

The particular features and advantages of the invention as well as other objects will become apparent from the following description taken in connection with the accompanying drawings, in which:

FIG. 5(*b*) is a cross-sectional view showing the structure of the ink jet printer on which the head unit shown in FIG. 5(*a*) is mounted;

FIG. 5(*c*) is a cross-sectional view showing the head unit mounted on the ink jet printer;

FIG. 16(*b*) is an explanatory diagram illustrating the operation of the wiper member;

FIG. 18(*b*) shows the wiper member in the waiting position;

FIG. 20(*b*) shows the wiper member in the wiping end position;

FIG. 21(*b*) shows the wiper member in the wiper cleaning waiting position;

FIG. 23(*b*) shows the wiper member when the cam gear is in the position shown in FIG. 23(*a*);

FIG. 24(*b*) shows the wiper member in the wiper cleaning end position;

FIG. 25(*b*) shows the wiper member when the cam gear is in the position shown in FIG. 25(*a*);

FIG. 26(*b*) shows the wiper member when the cam gear is in the position shown in FIG. 26(*a*);

FIG. 27(*b*) shows the wiper member when the cam gear is in the position shown in FIG. 27(*a*);

FIG. 28(*b*) shows the wiper member when the cam gear is in the position shown in FIG. 28(*a*);

FIG. 29(*b*) shows a motor speed control diagram when the wiper member is operating;

FIG. 29(*c*) shows a motor speed control diagram when the buffer purge pump is operating at which time a suction purge is performed;

FIG. 29(*d*) shows a motor speed control diagram when the buffer purge pump is operating at which time the suction purge is not performed;

DETAILED DESCRIPTION OF THE PREFERRED EMBODIMENTS

Figure 1:
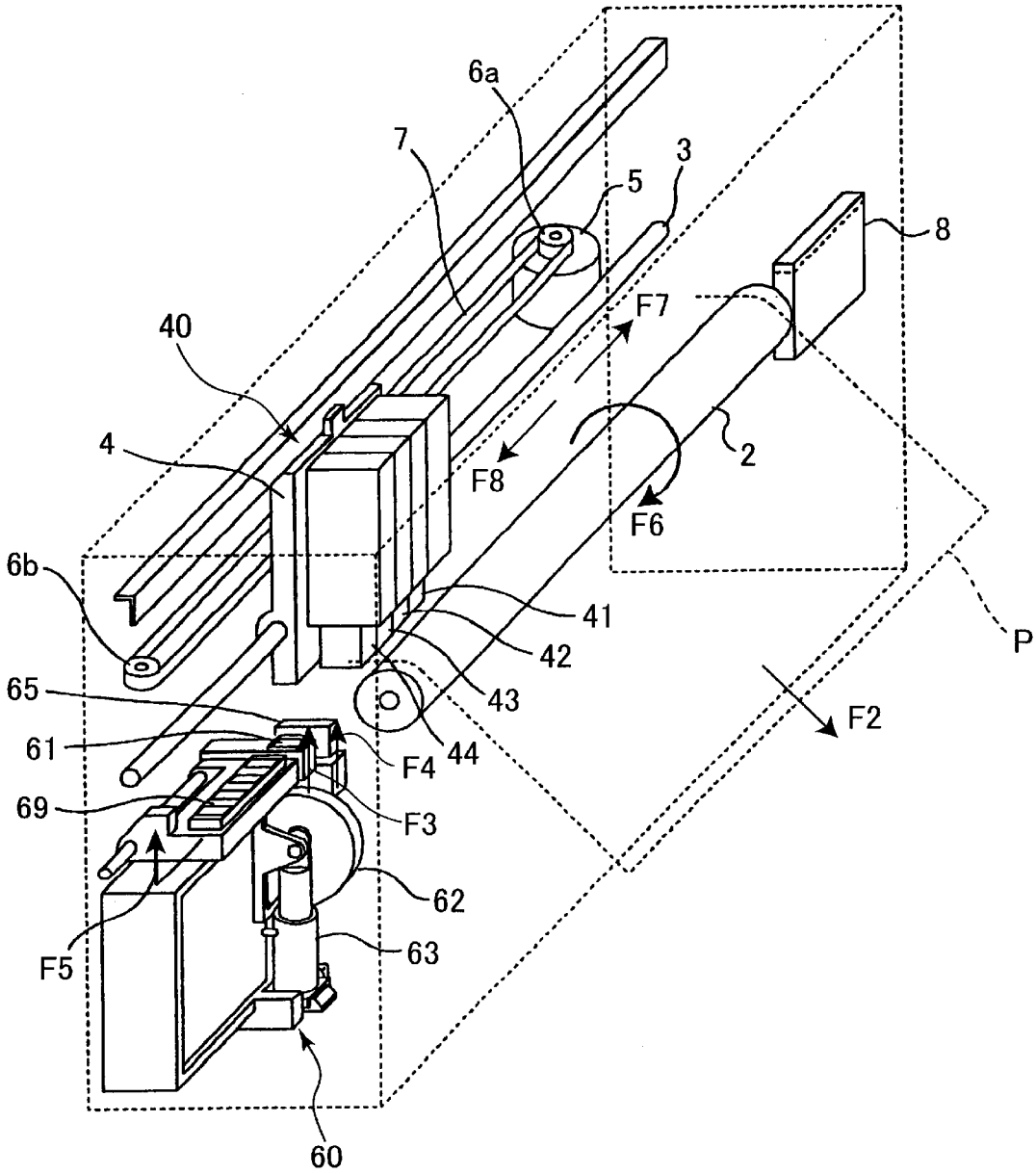
FIG. 1 a perspective view showing a part of the inner structure of an ink jet printer according to an embodiment of the invention.

An ink jet printer according to the preferred embodiment of the invention will he described with reference to the accompanying drawings. FIG. 1 is a perspective view showing a part of the inner structure of the ink jet printer according to the embodiment of the invention. The terms "upward", "downward", "upper", "lower", "above", "below", "beneath" and the like will be used throughout the description assuming that the ink jet printer is disposed in an orientation in which it is intended to be used. In use, the printer is disposed as shown in FIG. 1. An ink jet head 40 ejects ink droplets downwardly toward a printing sheet P, which is held horizontally beneath the head 40.

The ink jet printer includes a platen roller 2 that is rotatable about its own axis in a direction indicated by arrow F6. In accordance with the rotations of the platen roller 2, the printing sheet P is transported in the direction indicated by arrow F2. A carriage rod 3 is disposed in the vicinity of and in parallel with the platen roller 2. The printing sheet P passes the space between the platen roller 2 and the carriage rod 3. A carriage 4 on which the ink jet head 40 is mounted is slidably movably supported on the carriage rod 3. A carriage motor 5 is disposed near one side of the carriage rod 3. A pulley 6*a* is fixedly attached to the driving shaft of the carriage motor 5. Another pulley 6*b* is fixedly disposed near another side of the carriage rod 3. Between the two pulleys 5*a* and 6*b*, an endless belt 7 is stretched. The carriage 4 is fixed to the endless belt 7 so that the carriage 4 slidably reciprocates along the carriage rod 3 in the directions indicated by arrows F7 and F8 in accordance with rotations of the carriage motor 5.

Figure 2:
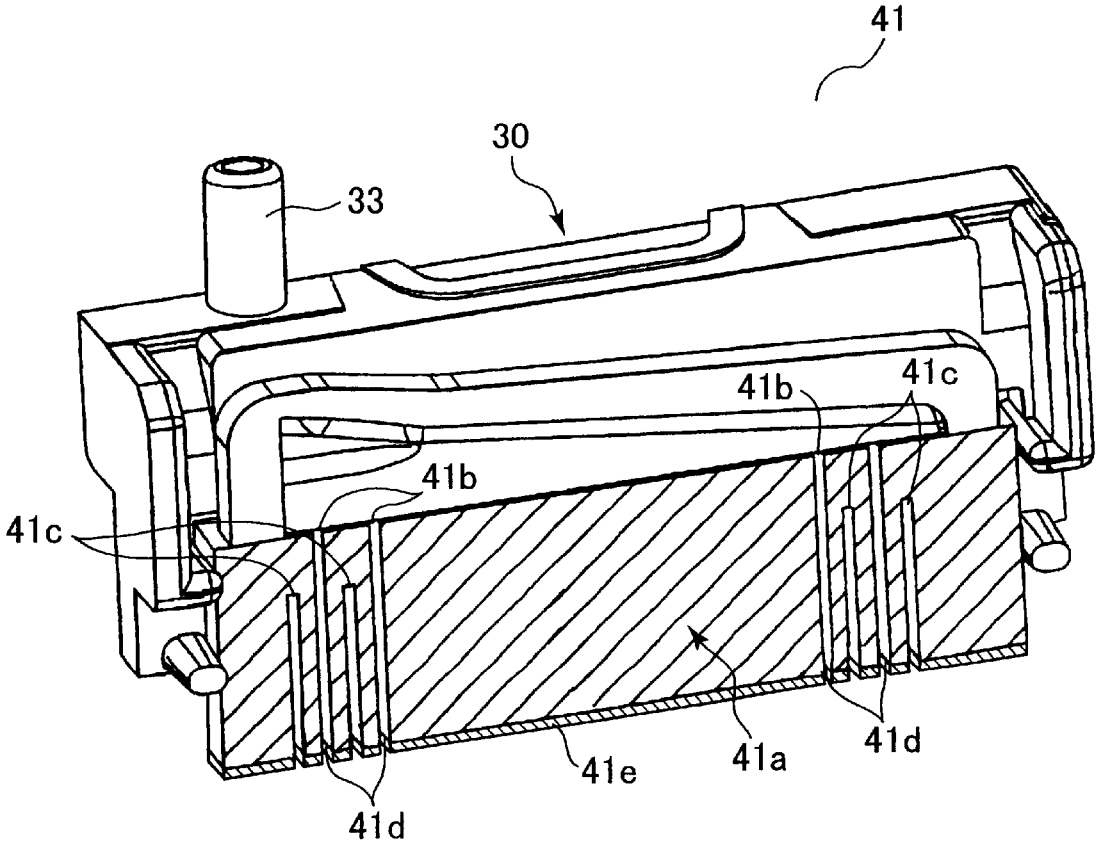
FIG. 2 is a cross-sectional view showing an ink jet head of the ink jet printer according to the embodiment of the invention.

The ink jet head 40 includes a black ink head 41 for ejecting black ink, a yellow ink head 42 for ejecting yellow ink, a cyan ink head 43 for ejecting cyan ink, and a magenta ink head 44 for ejecting magenta ink. FIG. 2 shows a detailed structure of the black ink head 41. Another ink heads have also the same structure. As shown therein, the ink head 41 includes an actuator 41*a* and a manifold 30. The actuator 41*a* is rectangular in shape and formed of a deformable material, such as a piezoelectric ceramic, for ejecting black ink droplets. As shown, one surface of the actuator 41*a* is formed with a plurality of ink chambers 41*b* and a plurality of dummy ink chambers 41*c* arranged parallel to one another at prescribed intervals, each extending in the ejection direction.

Each of the ink chambers 41*b* has an ink inlet in fluid communication with the manifold 30 on one end, and the other end is in fluid communication with a nozzle 41*d*. The ink chamber 41*b* is also provided with an electrode (not shown) for ejecting ink droplets from the ink chamber 41*b* through the nozzle 41*d*.

Referring back to FIG. 1, an ink absorption pad S made from a porous material is disposed beyond one end of the platen roller 2, at a position beyond the printable range on the printing sheet P. The ink absorption pad 8 is provided for absorbing ink ejected from the heads 41 to 44 at the time of flushing. Flushing is carried out for the purpose of discharging bubbles contained in the ink. The bubbles enter through the nozzles when a suction cap 61 is opened during suction purge. Flushing is also carried out at a predetermined interval in order to preserve ink ejection capability, which may otherwise be lost because ink in the nozzles dries out.

A purging device 60 is disposed beyond the opposite end of the platen roller 2 from the absorption pad 8, also at a position beyond the printable range on the printing sheet P. The purging device 60 is provided for restoring heads 41 to 44 that eject poorly or not at all to a good ejecting condition. The purging device 60 includes the suction cap 61. The suction cap 61 faces the ink jet head 40 when the ink jet head 40 reaches a purging position. At this time, the rotation of a cam 62 protrudes the suction cap 61 in the direction indicated by arrow F3 in FIG. 1 so as to selectively cover the nozzle surface of the heads 41 to 44. A suction pump 63 is driven to generate a negative pressure in the suction cap 61, thereby sucking defective ink, which includes air bubbles from the ink chambers of the heads 41 to 44, from the nozzles so that the heads are restored to properly functioning condition.

A wiper member 65 is provided at one side of the suction cap 61 nearer to the platen roller 2. The wiper member 65 is provided for wiping away ink and foreign matter that cling to the nozzle surface of the heads 41 to 44 that have been subjected suction purge. After suction purge is completed at each head, the ink jet head 40 is moved to a wipe position. Next, the wiper member 65 protrudes in the direction indicated by arrow F4 and wipes the nozzle surface of the heads 41 to 44 as they move toward the recording region. As a result, ink and the like is wiped from the nozzle surface so that the recording surface of the printing sheets P will not be stained by excessive ink.

A cap 69 is provided at another side of the suction cap 61 remote from the platen roller 2. The cap 69 is provided for covering the nozzle surface of the heads 41 to 44 of the ink jet head 40 after the ink jet head 40 returns to its home position. When the ink jet head 40 returns to its home position, the cap 69 protrudes in the direction indicated by arrow F5 and covers the nozzle surface of the heads 41 to 44. This prevents the ink in the heads 41 to 44 from drying while the printer is not being used.

Figure 3:
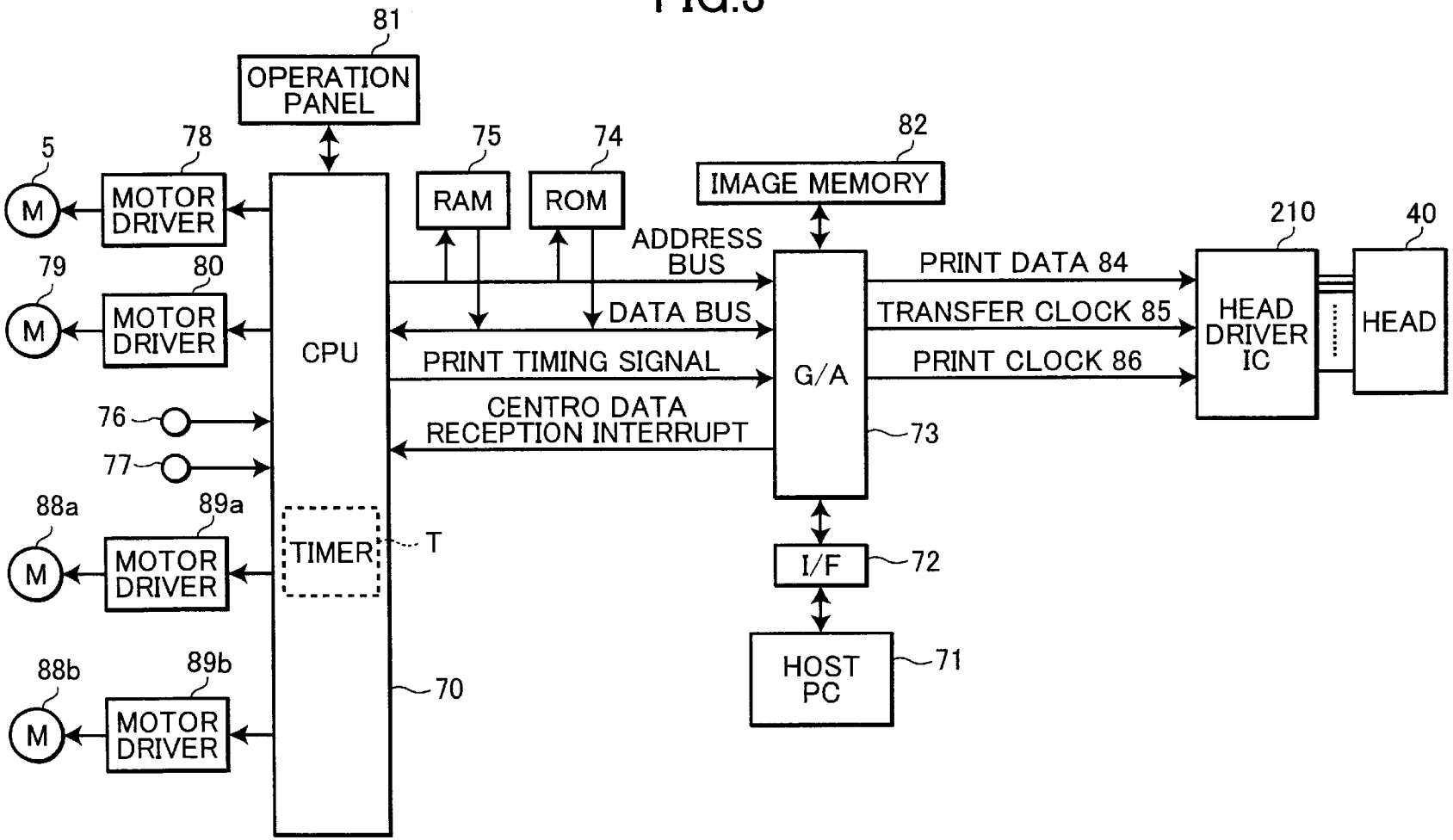
FIG. 3 is a block diagram showing a control system of the ink jet printer according to the embodiment of the invention.

Next, the main control system of the printer will be described while referring to the block diagram of FIG. 3. As shown in FIG. 3, the printer includes a CPU 70 and a gate array (G/A) 73. The CPU 70 is provided for controlling various components of the printer. The gate array 73 receives, through an interface 72, print data transmitted from a host computer 71 and performs control of development of the print data. The CPU 70 includes an internal timer T for measuring timing at which maintenance is to be performed on the ink jet head 40. A ROM 74 and a RAM 75 are connected to both the CPU 70 and the gate array 73. The ROM 74 stores operation programs, a number of ejections to be performed during flushing, and other data previously set. The RAM 75 temporarily stores print data that the gate array 73 has received from the host computer 71.

The CPU 70 is connected to a paper sensor 76, an origin sensor 77, an operation panel 81, and various motor drivers. The paper sensor 76 is provided for detecting presence and absence of a printing sheet P. The origin sensor 77 is provided for detecting whether the ink jet head 40 is at the home position. The motor driver 78 is provided for driving the carriage motor 5. The motor driver 80 is provided for driving a line feed motor 79 used for rotating the platen roller 2. The motor driver 89*a* and 89*b* are provided for driving an ink supply motors 88*a* and 88*b*, respectively. In this embodiment, a buffer purge pump 51 and a suction pump 63 (see FIG. 3) are configured to be selectively driven by switching rotational direction of the ink supply motor 88*a*. An ink supply pump 13 (see FIG. 3) is driven by the ink supply motor 88*b*. The ink supply motors 88*a* and 88*b* supply and circulate black, yellow, cyan and magenta inks in a manner to be described later.

The operation panel 81 is provided for entering a variety of signals to the CPU 70. An image memory 82 is connected to the gate array 73. The image memory 82 is provided for temporarily storing, as image data, print data that was received from the host compute 71. A head driver IC 210 operates to drive the ink jet head 40 based on print data 84, a transfer clock 85, and a print clock 86 output from the gate array 73.

Figure 4:
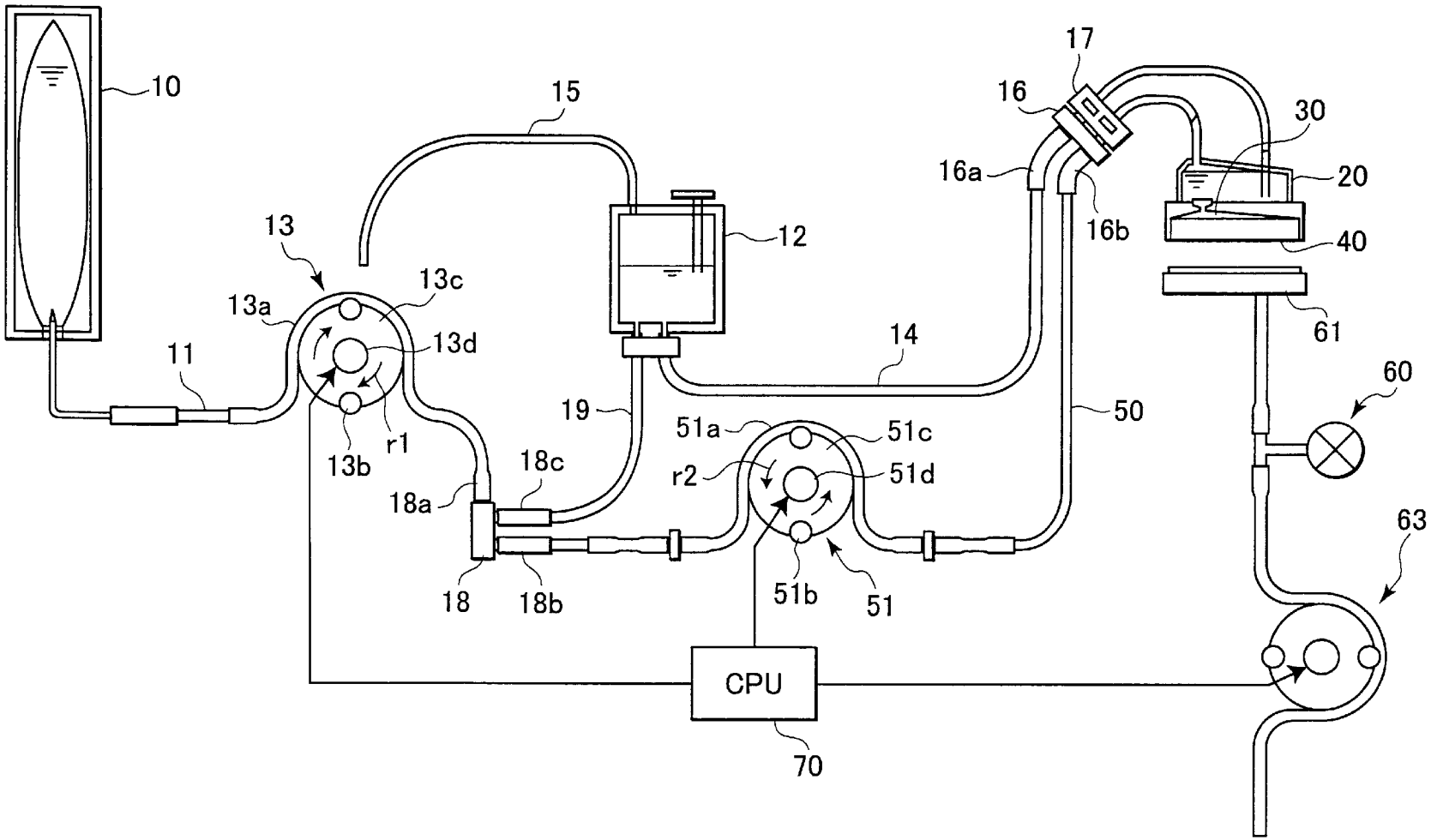
FIG. 4 is an explanatory diagram showing an ink channel of the ink jet printer according to the embodiment of the invention.

FIG. 4 shows an ink channel arrangement of the ink jet printer. An ink cartridge 10 is detachably mounted on the ink jet printer body 1 and contains a predetermined amount of ink. The ink cartridge 10 is fluidly connected to a sub-tank 12 through a first supply tube 11, an ink supply pump 13, a third joint 18 to be described later, and a second supply tube 19. Both the first and second supply tubes 11 and 19 are made from a flexible material. The ink cartridge 10 and the sub-tank serve as an ink supply source with respect to the ink jet head 40 to be described later.

The ink supply pump 13 is a conventionally known tube pump. The pump 13 includes a flexible and resilient tube member 13*a*, a plurality of pressurizing members 13*b* (two in the embodiment) for locally pressing the tube member 13*a*, a rotor 13*c* circumferentially supporting the pressurizing members 13*b*, and a motor shaft 13*d* connected to the ink supply motor 88*b*. The motor shaft 13*d* rotates the rotor 13*c*. In accordance with rotations of the rotor 13*c*, the portions on the tube member 13*a* where pressed by the pressurizing members 13*b* shift in a direction indicated by arrows r1, causing an ink flow to be generated from the ink cartridge toward the sub-tank 12.

In this embodiment, because the tube member 13*a* is wound around the rotor 13*c* over 180 degrees or more and two pressurizing members 13*b* are provided at radially opposite positions of the rotor 13*c*, at least one pressurizing member 13*b* is always in pressing contact with the tube 13*a*. As such, when the ink supply pump 13 is stopped, the pressuring member 13*b* interrupts the flow of ink.

Other than the ink supply pump 13, the ink channel arrangement includes two other pumps, a buffer purge pump 51 to be described later, and a suction pump 63. Both the buffer purge pump 51 and the suction pump have a similar arrangement to the ink supply pump 13. The ink supply motor 88*a* for these pumps is connected to the CPU 70 as described previously.

The sub-tank 12 has an upper portion open to atmosphere through an air discharge tube 15. Ink stored in the sub-tank 12 is supplied to a buffer tank 20 through a third flexible supply tube 14, a first joint portion 16 to be described later, and a second joint portion 17. Ink in the buffer tank 20 is supplied to a manifold 30 and the ink in the manifold 30 is in turn distributed to a plurality of ink ejection channels formed in the ink jet head 40. Pressure is selectively applied to ink in ink chambers so that ink droplets are ejected from the corresponding nozzles to form a desired dot pattern.

Air in the upper space of the buffer tank 20 enters into the ink. Therefore, the ink with air bubbles is circulated to the sub-tank 12 through the second joint portion 17, the first joint portion 16, a buffer purge tube 50, the buffer purge pump 51, the third joint 18, and the second supply tube 19.

The buffer purge pump 51 is fluidly connected to the buffer purge tube 50 and creates the flow of ink with air bubbles. The buffer purge pump 51 includes a flexible and resilient tube member 51*a*, a plurality of pressurizing members 13*b* (two in the embodiment) for locally pressing the tube member 51*a*, a rotor 51*c* circumferentially supporting the plurality of pressurizing members 51*b*, and a motor shaft 51*d* selectively connected to the ink supply motor 88*a*. The motor shaft 51*d* rotates the rotor 51*c*. In accordance with rotations of the rotor 51*c*, the portions on the tube member 51*a* where pressed by the pressurizing members 51*b* shift in a direction indicated by arrows r2, causing an ink flow to be generated from the buffer tank 20 toward the sub-tank 12.

The third joint 18 is formed with a first inlet 18*a*, a second inlet 18*b* and an outlet 18*c*. Ink from the ink supply pump 13 is introduced into the third joint 18 via the first inlet 18*a*. Ink and/or air from the buffer purge pump 51 are introduced into the third joint 18 via the second inlet 18*b*. The flow of ink and/or air from the first and second inlets 18*a* and 18*b* are mixed and supplied to the sub-tank 12 through the outlet 18*c*. The outlet 18*c* is fluidly connected to the sub-tank 12 through the second supply tube 19.

The sub-tank 12 has a bottom formed with an ink inlet port to which the second supply tube 19 is connected, and an ink outlet port to which the second supply tube 14 is connected. With such a structure, fresh ink from the ink cartridge 10 does not fall from an elevated position, but is introduced into the sub-tank 12 without generating bubbles and mixing air with the ink. As soon as ink mixed with air and/or ink in which air bubbles are mixed in the buffer purge pump 51 enter into the sub-tank 12 through the inlet port, air and/or bubbles move upwardly with the result that the ink in the sub-tank 12 does not contain air or air bubbles. Ink in the sub-tank 12 is supplied from the outlet port to the buffer tank 20 through the third supply tube 14.

The buffer purge pump 51 stops its pumping operation under certain circumstances including when the ink jet head 40 is ejecting ink droplets at the time of printing or flushing, when the suction pump 63 is performing a suction purging, and when the wiper member 65 is wiping off an ink clinging to the ink jet head 40. When the buffer purge pump 51 is stopped, at least one pressurizing member 51*b* closes the channel so that the buffer tank 20 is held in a hermetically sealed condition. The pressure imparted on the ink jet head 40 is maintained negative due to the difference in height between the ink jet head 40 and the sub-tank 12.

Figure 5A:
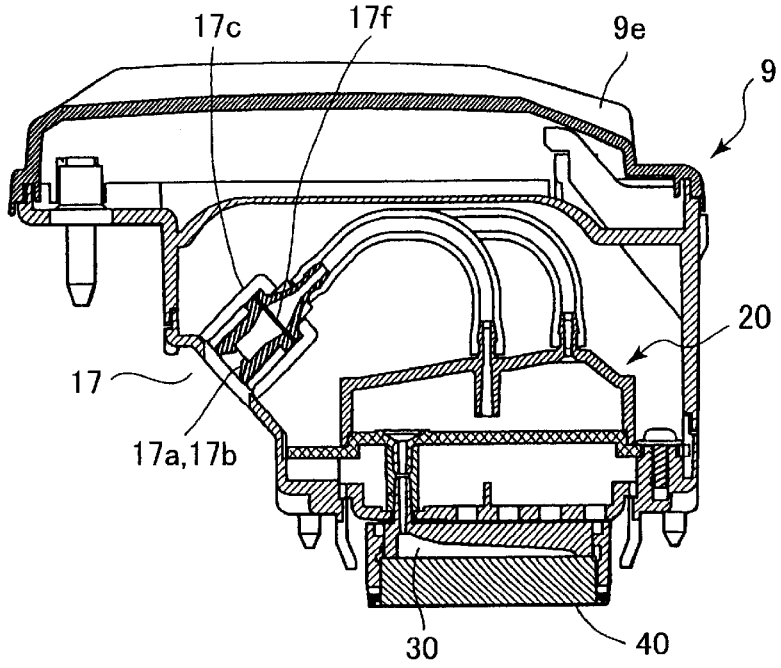
FIG. 5(*a*) is a cross-sectional view showing a head unit.
Figure 5B:
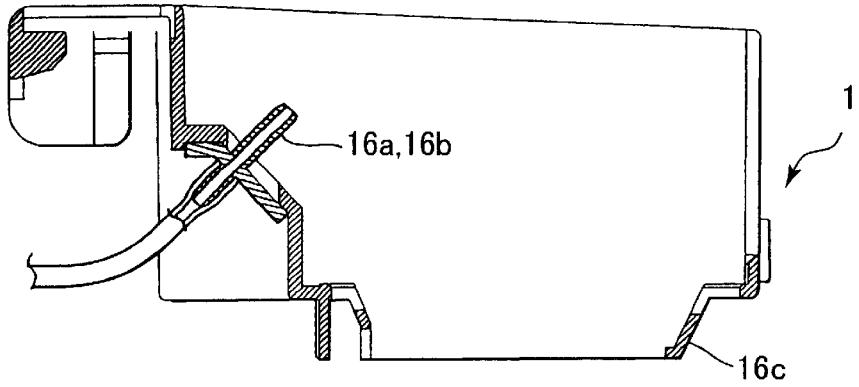
Figure 5C:
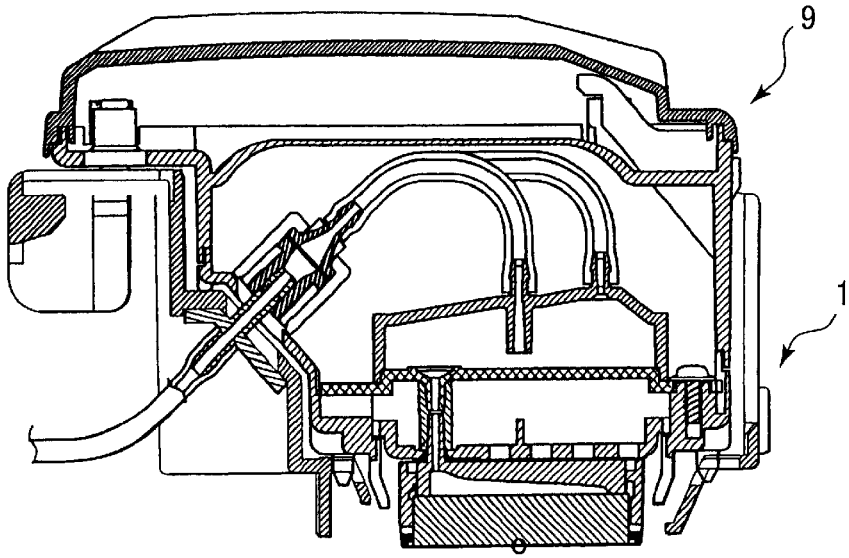
Figure 6:
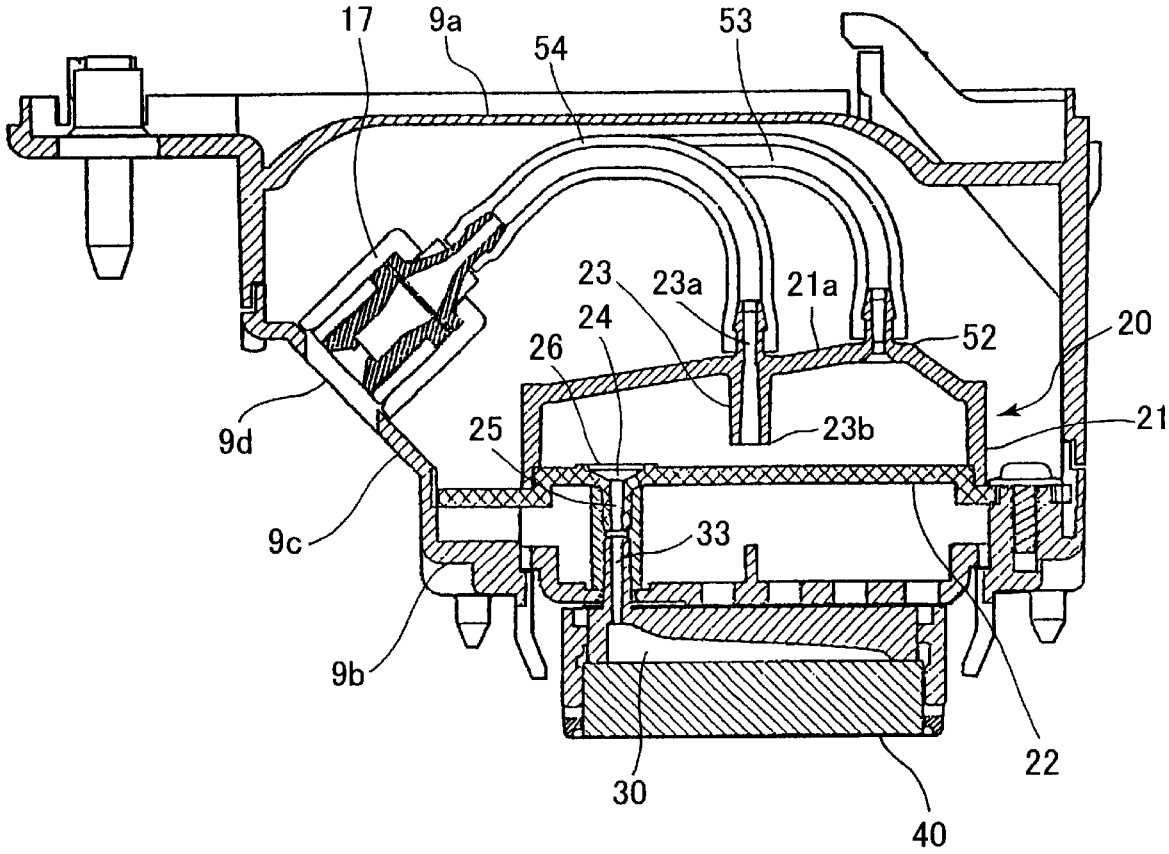
FIG. 6 is an enlarged cross-sectional view showing the head unit.

FIGS. 5(*a*) through 5(*c*) and 6 are cross-sectional views showing a structure of a head unit 9 detachably mounted on the ink jet printer body 1. FIG. 5(*a*) is a cross-sectional view showing the head unit 9. FIG. 5(*b*) is a cross-sectional view showing the structure of the ink jet printer body 1 on which the head unit 9 is to be mounted. FIG. 5(*c*) is a cross-sectional view showing the head unit 9 mounted on the ink jet printer body 1. FIG. 6 is an enlarged cross-sectional view showing the head unit 9.

The head unit 9 includes the second joint portion 17, the buffer tank 20, the manifold 30 and the ink jet head 40, all of which are supported by an upper casing 9*a* and a lower casing 9*b*. A cover 9*e* is attached to the upper surface of the upper casing 9*a* for aesthetic reasons.

The buffer tank 20 is defined by a first casing 21 and a second casing 22, both made by injection molding using a compound resin material. The first casing 21 includes a ceiling wall and side walls, with the lower side open. The second casing 22 is positioned facing and hermetically sealed to the open lower side of the first casing 21, and forms the bottom wall of the buffer tank 20. A hollow tubular wall 23 is formed in the ceiling wall of the first casing 21. The hollow tubular wall 23 extends vertically and protrudes upward out from the buffer tank 20 and downward into the buffer tank 20. An ink introduction port 23*b*, which is the lower end of the hollow tubular wall 23, is disposed near to the inner surface of the second casing 22. An introduction tube 54 is connected to the hollow tubular wall 23. The introduction tube 54 is provided for introducing ink supplied from the sub-tank 12, through the third supply tube 14, into the buffer tank 20.

With this configuration, the ink supplied from the sub-tank 12 is supplied into the buffer tank 20 near the bottom of the buffer tank 20, thereby preventing the ink from dropping from a height and forming bubbles. In particular, introduction of ink will cause almost no disturbance, such as generation of bubbles, when the ink introduction port 23*b* is submerged under the ink.

Figure 22A:
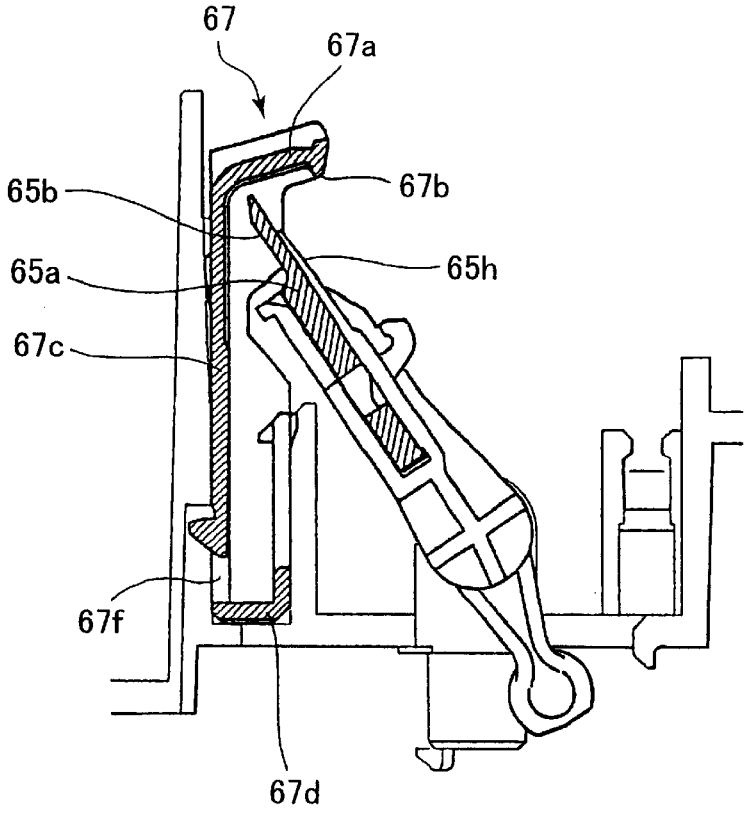
FIGS. 22(*a*) and 22(*b*) are explanatory diagrams illustrating the operation of the wiper member.
Figure 22B:
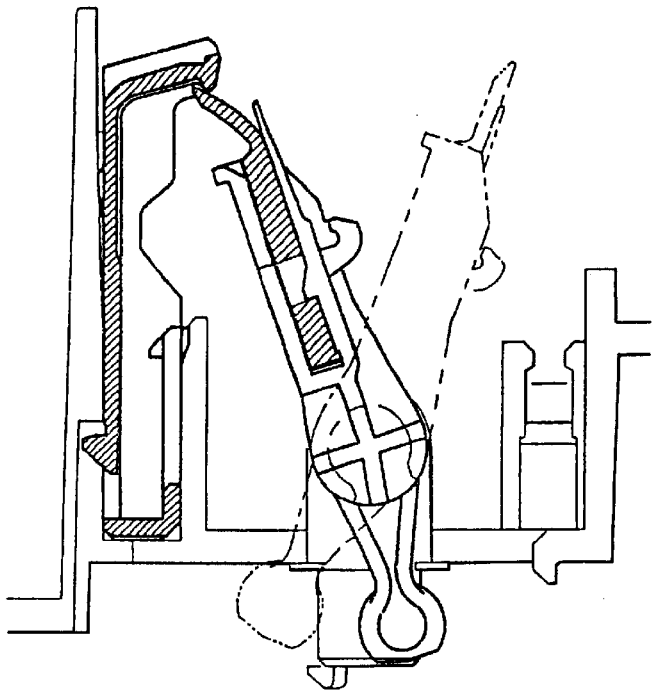

The manifold 30 is disposed below the buffer tank 20. blade member 65 as shown in FIGS. 22(*a*) and 22(*b*).

The blade cleaner 67 is formed from a synthetic resin into an integral body including a top plate 67*a*, a back plate 67*c*, and a box-shaped support portion 67*b*. The top plate 67*a* has an inner surface that is slanted with respect to an imaginary horizontal plane. The back plate 67*c* has a vertically upright posture and is connected to the top plate 67*a*. The support portion 67*d* is provided to the lower section of the back plate 67*c*. A protrusion portion 67*b* is provided on the tip portion of the top plate 67*a*, that is, at the center-left edge as viewed in FIGS. 19(*a*) and 19(*b*). The protrusion portion 67*b* protrudes downward as viewed in FIGS. 19(*a*) and 19(*b*) and is formed with a blunt tip.

Figure 19A:
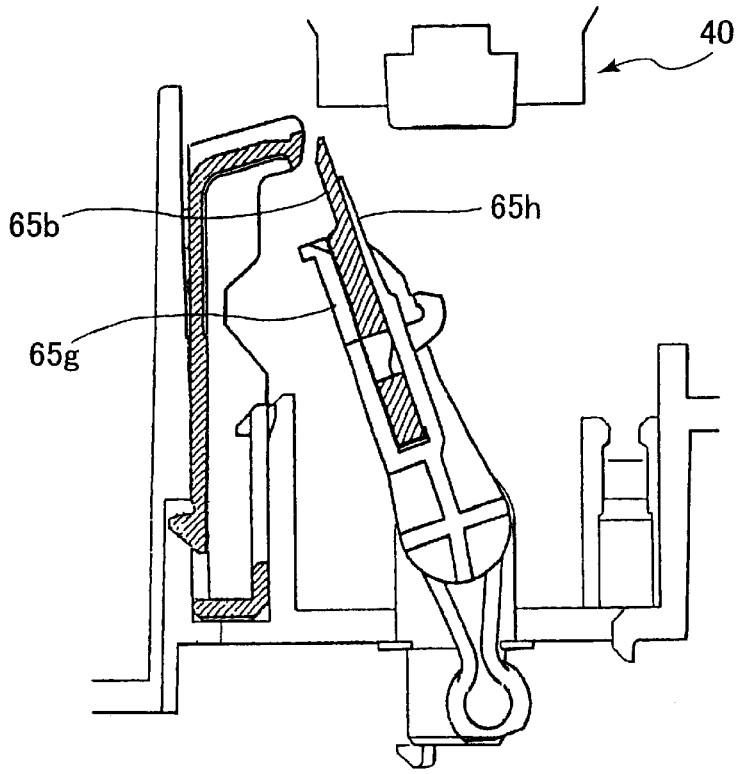
FIGS. 19(*a*) and 19(*b*) are explanatory diagrams illustrating the operation of the wiper member.
Figure 19B:
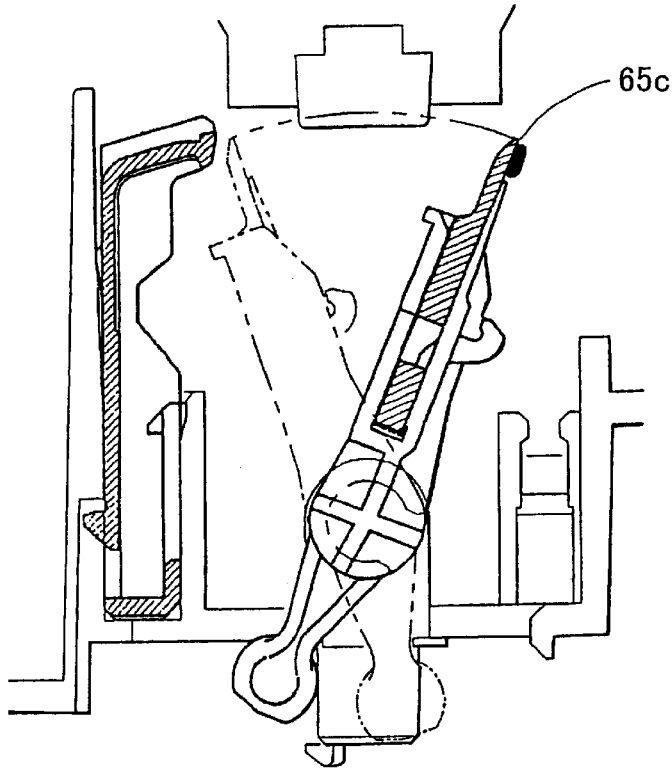

FIG. 19(*b*) shows the rubber blade 65*a* after wiping the nozzle surface of the ink jet head 40. Ink is shown clinging to the rubber blade 65*a* in exaggerated size to facilitate understanding. Even if the ink is drawn into between the front wall 65*h* and the rubber blade 65*a* by capillary action, the surface of the rubber blade 65*a* near the tip portion 65*c* will still be wet from clinging ink when the wiper member 65 is moved back to the position shown in FIG. 22(*a*). To wipe this ink from the surface of the rubber blade 65*a* near the tip portion 65*c*, the wiper member 65 is moved from the position shown in FIG. 22(*a*) to the position shown in two dot chain line in FIG. 22(*b*). As a result, the ink-wetted The manifold 30 is provided for supplying ink to the ink chambers of the ink jet head 40. An ink supply port 24 is formed in the second casing 22, which forms the bottom of the buffer tank 20. A supply pipe 25 is formed on the ink supply port 24 so as to protrude downward. An introduction pipe 33 is formed so as to protrude from the upper side of the manifold 30 at a position corresponding to the position of the supply pipe 25. A filter 26 is disposed on the second casing 22 so as to cover the ink supply port 24. That is, the filter 26, the ink supply port 24, the supply pipe 25, and the introduction pipe 33 configure an ink supply channel for supplying ink from the buffer tank 20 to the manifold 30.

The ceiling wall 21*a* of the first casing 21 of the buffer tank 20 is formed curved surface or with a slanted surface that intersects an imaginary horizontally extending plane. An outflow port 52 is formed in the uppermost portion of the ceiling wall 21*a*. An outflow tube 53 is connected to the outflow port 52. The outflow tube 53 is provided for removing ink mixed with air and bubbles and feeding the ink back into the buffer purge tube 50.

That is, bubbles generated in the ink collect at the uppermost portion of the ceiling wall 21*a* of the buffer tank 20 and are discharged out from the buffer tank 20 through the outflow port 52. In contrast to this, ink in good condition, that is, without any bubbles, accumulates near the bottom, surface of the buffer tank 20 and is supplied downward to the manifold 30 through the filter 26. Accordingly, only ink in a good condition, that is, without bubbles or foreign material, is supplied to the ink jet head 40.

As shown in FIG. 5(*a*), the second joint portion 17 is configured from an introduction joint 17*a*, an outflow joint 17*b*, and a joint cover 17*c*. The introduction joint 17*a* is connected to the introduction tube 54. The outflow joint 17*b* is connected to the outflow tube 53. The joint cover 17*c* supports the introduction joint 17*a* and the outflow joint 17*b*. In the drawing, the introduction joint 17*a* and the outflow joint 17*b* are aligned in a direction perpendicular to the sheet surface of FIG. 5(*a*). The introduction joint 17*a* and the outflow joint 17*b* are configured in a substantial cylinder shape and are disposed with a tilt of about 35 to 55 degrees from an imaginary vertical line. Accordingly, openings of the introduction joint 17*a* and the outflow joint 17*b* configure an imaginary plane that intersects an imaginary horizontal plane. Also, the introduction joint 17*a* and the outflow joint 17*b* include an internal filter 17*f*.

The lower casing 9*b* includes a slanting surface 9*c* where the second joint portion 17 is located. A vertically extending aperture 9*d* is formed in the slanting surface 9*c*. Because the joint cover 17*c* confronts the slanting surface 9*c*, the openings of the introduction joint 17*a* and the outflow joint 17*b* are disposed at a position confronting the aperture 9*d*. Further, the lower end of the aperture 9*d* and the lower end of the openings of the introduction joint 17*a* and the outflow joint 17*b* are disposed at substantially the same horizontal position.

Accordingly, even if ink drips from the end of the openings of the introduction joint 17*a* and the outflow joint 17*b* when the head unit 9 is detached from the carriage 4, the dripping ink will fall onto the slanting surface 9*c* below the aperture 9*d* and will accumulate in the lower casing 9*b*. Also, the filters 17*f* provided at the introduction joint 17*a* and the outflow joint 17*b* are wet from ink. Therefore, air will not enter into the introduction tube 54 or the outflow tube 53 when the head unit 9 is detached from the carriage 4. The filter 17*f* will prevent most of the ink leak even if ink from the introduction tube 54 or the outflow tube 53 leaks through the openings of the introduction joint 17*a* and the outflow joints 17*b*.

The first joint portion 16 is provided to the carriage 4. The first joint portion 16 is configured from a supply joint 16*a* connected to the introduction joint 17*a*, a circulation joint 16*b* connected to the outflow joint 17*b*, and a mounting portion 16*c*. The mounting portion 16*c* supports the supply joint 16*a* and the circulation joint 16*b* and also supports the head unit 9. As shown in FIG. 4, the supply joint 16*a* is connected to the third supply tube 14. The circulation joint 16*b* is connected to the buffer purge tube 50.

Accordingly, by mounting the head unit 9 onto the mounting portion 16*c*, the introduction joint 17*a* connects with the supply joint 16*a* and the outflow joint 17*b* connects with the circulation joint 16*b*.

Next, a description will be provided for the ink circulation pathway having the above-described configuration.

When a sensor 12*a* detects that the amount of ink in the sub-tank 12 has reached or gone below a certain fixed amount, then the ink supply pump 13 is drive to supply ink from the ink cartridge 10 into the sub-tank 12 until a predetermined amount of ink has accumulated in the sub-tank 12. This operation is performed independently from operations of the buffer purge pump 51, the suction pump 63, and the ink jet head 40. The ink supply pump 13 is configured from a well-known conventional tube pump as described above, and is either electrically or electromagnetically controlled or mechanically configured so that the rotor 13*c* rotates only in the direction indicated by arrow r1, that is, so that the rotor 13*c* can not rotate in the opposite direction. Accordingly, regardless of whether the ink supply pump 13 is operating or stopped, the flow of ink will not move in the reverse direction toward the ink cartridge 10.

In order to fill the buffer tank 20 and the ink jet head 40 with ink, the CPU 70 controls the suction cap 61 to hermetically seal all of the nozzles in the ink jet head 40 and the buffer purge pump 51 to operate. As a result, a negative pressure is developed within the buffer tank 20 and ink from the sub-tank 12 is efficiently introduced into the buffer tank 20. When the suction pump 63 is driven under control of the CPU 70 after ink has accumulated in the buffer tank 20 to a sufficient height above the ink supply port 24, ink in the buffer tank 20 fills all the ejection channels of the print head 40 from the ink supply port 24. As a result, ink that has all bubbles removed therefrom at the buffer tank 20 is supplied to the ink jet head 40 so that bubbles will not enter the ejection channels of the ink jet head 40.

During various situations, the operation of the buffer purge pump 51 is stopped so that the channel through the buffer purge tube 50 is closed off, thereby bringing the buffer tank 20 into a hermetically sealed condition. These various situations include ink ejection operation of the ink jet head 40, such as during printing and flushing operations, and also include suction purge performed by the suction pump 63 and wiping operations performed by the wiper member 65. As a result, the difference in height between the ink jet head 40 and the sub-tank 12 maintains a negative pressure within the ink jet head 40. When ink is ejected from the ink jet head 40, ink is supplied from the sub-tank 12 to the buffer tank 20 in an amount required to replenished the consumed ink.

At this time, the ink introduction port 23*b* is adjacent to the surface of the second casing 22, which forms the bottom surface of the buffer tank 20, and opens up into the ink so the ink supplied from the ink introduction port 23*b* does not froth up or become filled with air, as would be the case if the ink poured down onto and collided with an ink surface from above.

Periodically, or at an optional timing, the suction cap 61 covers the ejection openings of the ink jet head 4 in a hermetically sealed condition and the buffer purge pump 51 is driven for a predetermined duration of time. By this, any air or bubbles that have accumulated at the upper portion of the buffer tank 20 can be discharged through the introduction port 52. By this, air bubbles that have accumulated at the upper portion of the buffer tank 20 can be efficiently removed. Further, air bubbles generated in the third supply tube 14 is introduced into the buffer tank 20 along with ink so that the air bubbles can be separated from the ink and removed in the above-described manner.

In the same manner as the ink supply pump 13, the buffer purge pump 51 is configured so that the rotor 51*c* rotates, or is driven to rotate, only in the direction indicated by arrow r2. As a result, ink or air will not flow backwards toward the buffer tank 20, whether the buffer purge pump 51 is being driven or not.

In this way, the buffer purge pump 51 performs ink circulation between the sub-tank 12 and the buffer tank 20 so that clean ink without any air bubbles can be always supplied to the ink jet head 40, without using a valve mechanism or other complicated configuration. Here, the buffer purge pump 51 operates in the direction for generating a negative pressure in the buffer tank 20. Therefore, ink will not leak from the nozzles of the ink jet head 40, even if the amount of ink circulated per unit time is increased to quickly perform ink circulation.

Ink circulation through the ink circulation pathway is not switched by operation of valves but by the operation of the buffer pump 51 configured from a tube pump that can not be operated in reverse. Therefore, the switching operation by the buffer pump 51 will not cause ink to flow in reverse and will not induce fluctuations in ink pressure, which can disrupt the menisci at the nozzles of the print head.

It should he noted that the above-described drive of the buffer purge pump 51 can be performed directly before a suction purge operation (to be described later) or periodically such as after a long duration of time has elapsed (such as once a week) or after a short duration of time has elapsed (such as the time required to print a predetermined number of sheets). If performed periodically, then the timing can be adjusted depending on the ambient temperature. The various tubes of the ink circulation pathway are made from a material penetrable by gases. When the printer has not been operated for long periods of time, gas can pass through the tubes so that bubbles are generated throughout the ink circulation pathway. In such a situation, a large volume of ink can be circulated so that air bubbles from the third supply tube 14 and the head unit 9 accumulate at the upper portion of the sub-tank 12, and are removed from the third supply tube 14 and the head unit 9.

Figure 7:
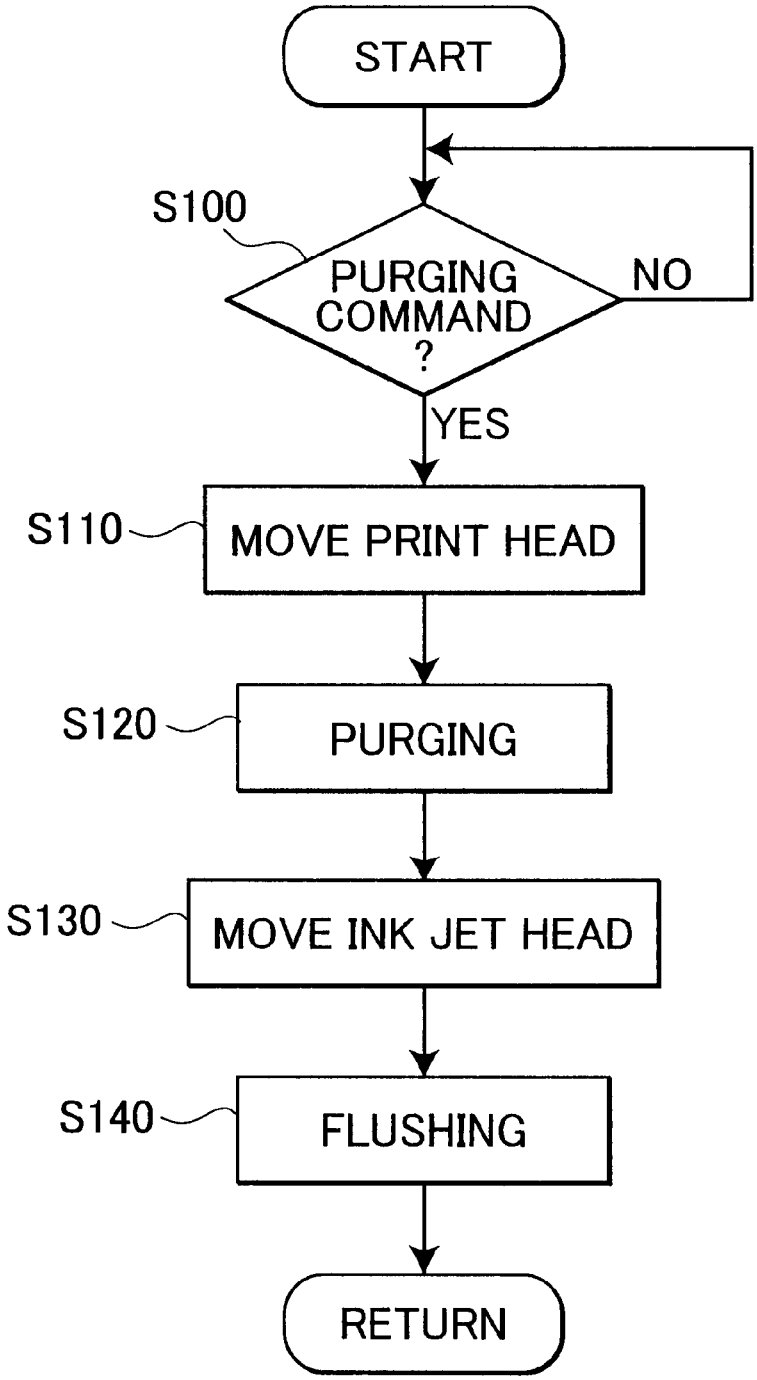
FIG. 7 is a flowchart illustrating control processes of purging and flushing operations.

Next, control operations performed by the CPU 70 during suction purge and flushing will be described with reference to the flowchart of FIG. 7.

The suction purge operation can be started under a variety of situations. For example, the suction purge operation can be performed before a printing operation is started. In this case, the suction purge can be changed in accordance with the duration of the non-use period before the printing operation, that is, in accordance with the duration of time measured by the timer T of the CPU 70. Also, the suction purge can be performed after an ink cartridge is exchanged in order to suck ink from the new cartridge into the head using the suction pump 63. Alternatively, the suction purge operation can be performed when a user presses an operation key upon discovering defective ink ejection.

When the signal of the suction purge command is automatically or optionally output in the above-described manner (S101), then the ink jet head 40 is moved to the purge position facing the suction cap 61 (S110). Then the suction cap 61 is driven to cover the nozzle surface of the ink jet head 40. After the buffer purge pump 51 is stopped, the suction pump 63 is driven to suck ink from the nozzles of the ink jet head 40 (S120). This suction purge operation suck detective ink, which includes bubbles, from the ink chambers of the ink jet head 40.

When the suction purge operation is completed, then the ink jet head 40 is moved to the flushing position via the wiping position (S130). During this operation, the buffer purge pump 51 remains turned off. When the ink jet head 40 moves past the wiping position, the wiper member 65 wipes the nozzle surface. Then flushing is performed by ejecting ink from the ink chambers toward the ink absorption pad 8 (S140). During the flushing operation, the buffer purge pump 51 is turned off. The flushing operation reliably ejects, along with the ink, any bubbles that entered the ink chambers during suction purge.

Next, the operation of the buffer purge pump 51 and the wiper member 65 will be described while referring to the drawings.

Figure 8:
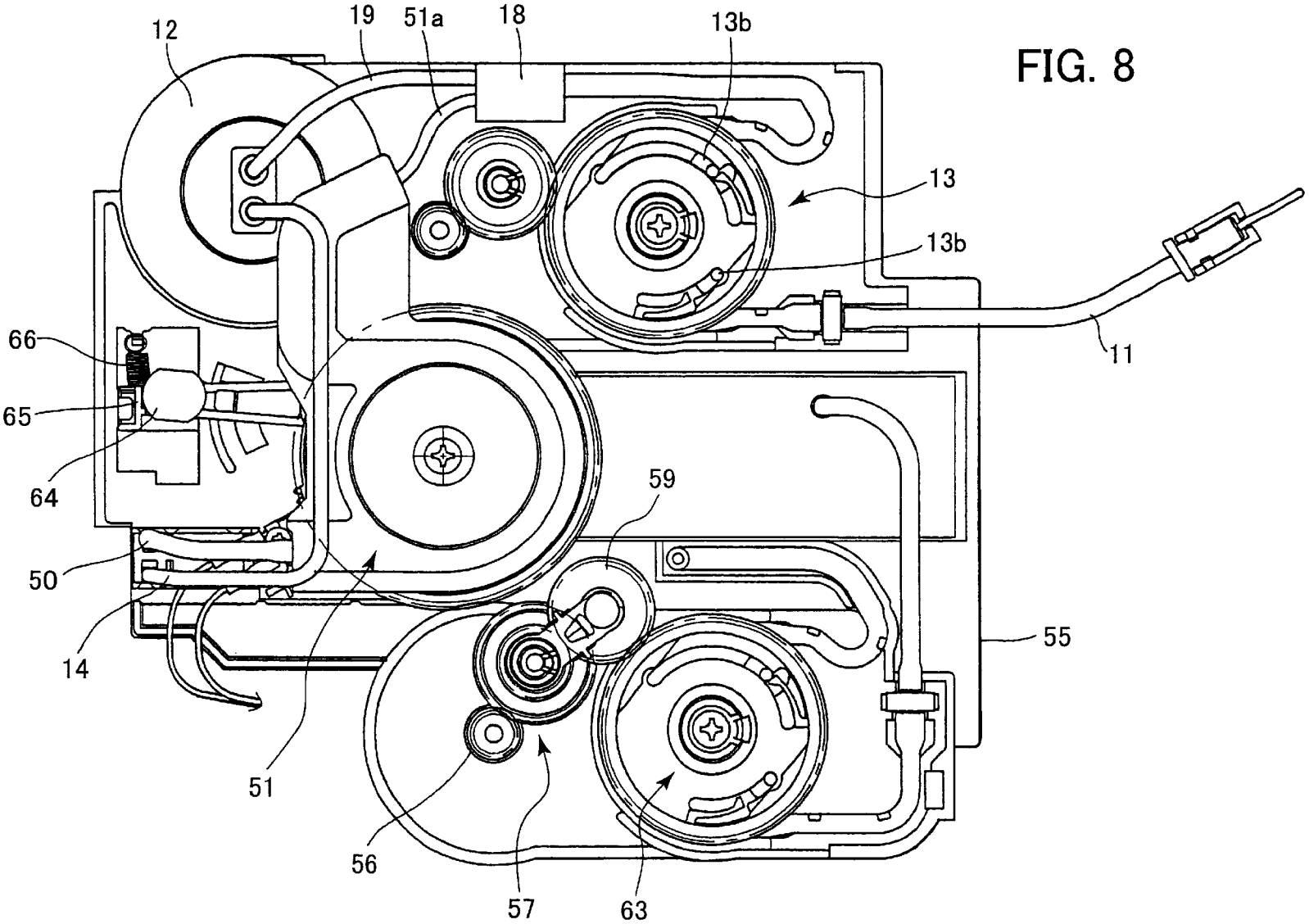
FIG. 8 is a plan view showing an ink circulation unit.

FIG. 8 is a plan view showing an ink circulation unit which contains configuration of executing ink circulation of ink in the printer body 1.

As shown in FIG. 8, a planetary gear mechanism 57 is assembled into a pump unit frame 55 with the ink supply pump 13, the third joint 18, the second supply tube 19, the sub-tank 12, the third supply tube 14, the buffer purge tube 50, the buffer purge pump 51, the motor shaft gear 56, the suction pump 63, and the wiper member 65.

According to the present embodiment, the buffer purge pump 51 and the suction pump 63 are configured to be selectively driven by switching rotational direction of a single ink supply motor 88*a* shown in FIG. 3. That is, the planetary gear mechanism 57 transmits drive force from the motor shaft gear 56 to the buffer purge pump 51 or the suction pump in accordance with the rotational direction. The motor shaft gear 56 and the planetary gear mechanism 57 are disposed in the pump unit frame 55. The motor shaft gear 56 is attached to the drive shaft of the ink supply motor 88*a*. Also, the ink supply pump 13 is driven by the ink supply motor 88*b*.

Figure 9A:
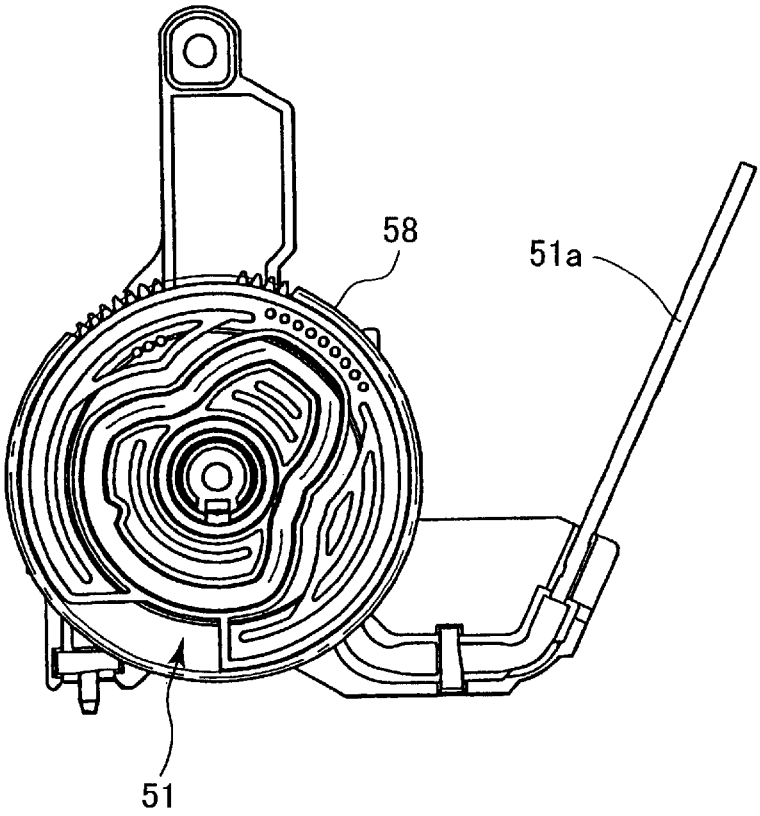
FIGS. 9(*a*) and 9(*b*) show a buffer purge pump.
Figure 9B:
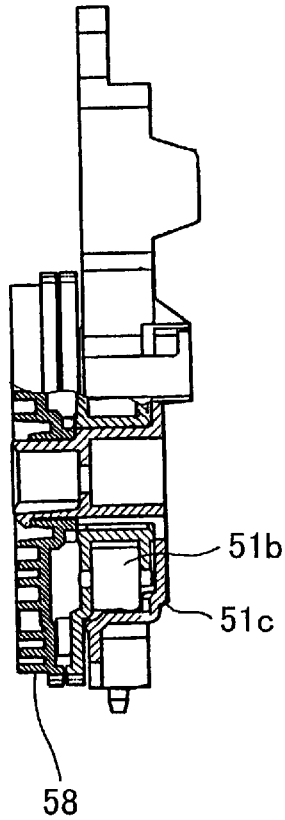
Figure 10A:
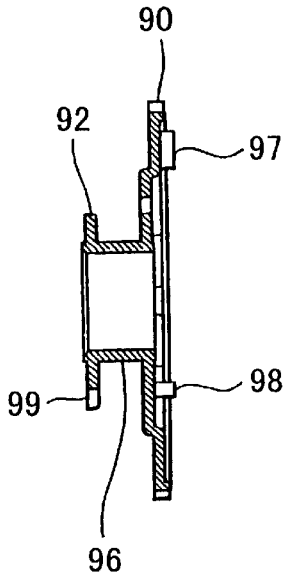
FIGS. 10(*a*) to 10(*d*) show a rotor of the buffer purge pump.
Figure 10B:
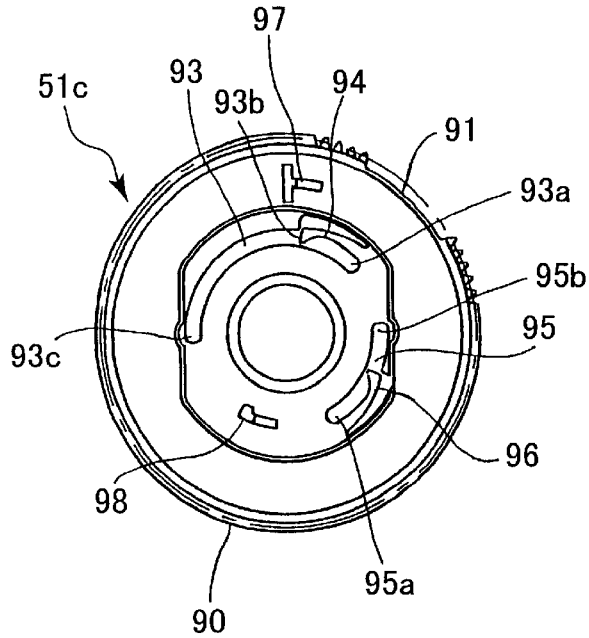
Figure 10C:
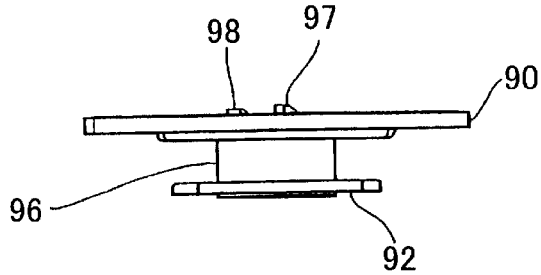
Figure 10D:
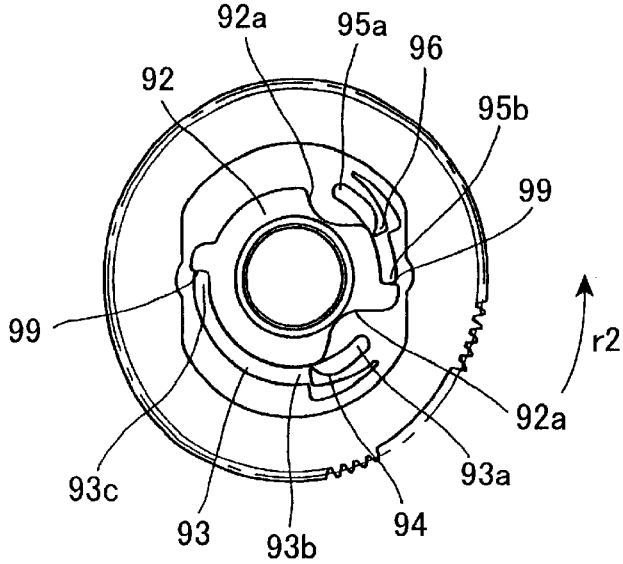

FIGS. 9(*a*) to 12 are views showing a drive mechanism for driving the buffer purge pump 51 and the wiper member 65.

As best shown in FIG. 10(*a*), the rotor 51*c* is formed integrally from synthetic resin and includes a pump gear 90, a plate-shaped flange portion 92, and a cylindrical portion 96. The pump gear 90 is formed with gear teeth at most, but not all, of its outer periphery. That is, the pump gear 90 is formed with a non-geared portion 91 at a portion of its outer periphery. The cylindrical portion 96 is coaxial with and connects together the pump gear 90 and the flange portion 92.

As shown in FIG. 10(*b*), the pump gear 90 is formed with first and second annular grooves 93, 95 at the outer side of the cylindrical portion 96. The first and second annular grooves 93, 95 each forms an arc shape with the same radius centered on the rotational center axis of the pump gear 90. The first and second annular grooves 93, 95 are provided facing the rotational center axis of the pump gear 90 with one end 93*c* of the first annular groove 93 symmetrical with one end 95*b* of the second annular groove 95 centered on the rotational center axis of the pump gear 90.

The flange 92 is a substantially disc shaped member centered on the rotational center axis of the pump gear 90. The flange portion 92 includes a two fifth protrusions 99 positioned symmetrically centered on the rotational center axis at positions corresponding to the end 93*c* of the first annular groove 93 and the end 95*b* of the second annular groove 95. As shown in FIG. 10(*a*), the flange portion 92 also includes two arc shaped non-geared portions 92*a* provided at positions corresponding to the other end 93*a* of the first annular groove 93 and the other end 95*a* of the second annular groove 93*a*. The arc-shaped non-geared portions 92*a* have a radius slightly larger than the radius of the pressurizing members 51*b*.

Two pressurizing members 51*b* each formed from a cylindrical-shaped roller-shaped member are disposed between the pump gear 90 and the flange portion 92. One end of a central shaft formed at both ends of the pressurizing members 51*b* are fitted through the first and second annular grooves 93, 95. The other end of the central shaft of the pressurizing members 51*b* abut against the outer periphery of the flange 92. Also, a pair of fifth protrusions 99 are formed at the outer periphery of the flange portion 92. The fifth protrusions 99 rotate in the direction indicated by arrow r2 with rotation of the rotor 51*c* and urge the center shaft of the pressurizing members 51*b* in the direction indicated by arrow r2 so that the pressurizing members 51*b* rotate in the direction indicated by arrow r2.

A resilient support member 94 is provided at the first annular groove 93, so as to extend into the first annular groove 93. Also a resilient support ember 94 is provided at the second annular groove 95, so as to extend into the second annular groove 95.

Figure 12:
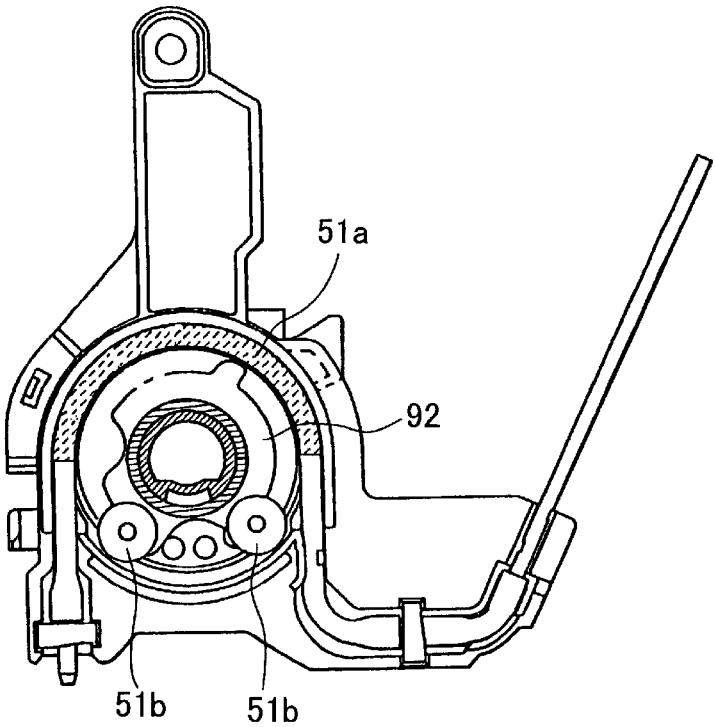
FIG. 12 shows the a buffer purge pump.

The resilient support member 94, the first annular groove 93, and the second annular groove 95 facilitate assembly and shipment of the buffer purge pump 51. That is, a person assembling the pressurizing members 51*b* first aligns the pressurizing members 51*b* with the non-geared portions 92*a* of the flange 92, with the central shaft of one of the pressurizing members 51*b* positioned at the other end 93*a* of the first annular groove 93 and the central shaft of the other pressurizing member 51*b* at the other end 95*a* of the second annular groove 95. Next, the person moves the central shaft of one of the pressurizing members 51*b* toward the end 95*b* of the second annular groove 95 and the central shaft of the other pressurizing member 51*b* toward the end 93*c* of the first annular groove 93 and over the resilient support portion 94. Then, the person positions one of the center shafts of the pressurizing members 51*b* at the position directly after the center shaft passes over the resilient support portion 94 and another of the center shafts at the end 95*b* of the second annular groove 95. This condition is shown in FIG. 12. At time of shipment of the printer 1, the tube member 51*a* is not compressed by the pressurizing member 51*b*. That is, there is no way to know how much time will elapse after the printer is shipped out until the printer 1 is actually sold and used. If the flexible tube material 51*a* is maintained in a pinched condition by the pressurizing member 51*b* for a long period of time, there is a possibility the tube member 51*a* will become permanently deformed. Therefore, at time of shipment from the factory, the pressurizing member 51*b* is set in a condition so that it does not pinch the tube member 51*a*.

When the printer 1 is actually used and the rotor 51*c* is rotated in the direction indicated by arrow r2, the pressurizing members 51*b* abut against the tube member 51*a* so that resistance is generated. The resistance moves the central shafts of the pressurizing members 51*b* into abutment against the fifth protrusion 99 and rotates the pressurizing members 51*b* in the direction indicated by arrow r2

The pump gear 90 is also provided with first and second protrusions 97, 98 that protrude in the opposite direction from the flange 92.

The cam gear 58 is integrally formed from a synthetic resin. Gear teeth 58*a* are formed at the outer periphery of the cam gear 58. The gear teeth 58*a* has the same radius of pitch circle as the pump gear 90 of the rotor 51*c*. The cam gear 58 includes on one side a third protrusion 58*d*, which is capable of abutment with the first protrusion 97, and a four protrusion 58*e*, which is capable of abutment with the second protrusion 98, and on the other side a cam groove 58*c*, which is for driving the wiper 65. The cam groove 58*c* is provided with a notch 58*k*.

The cam gear 58 is also formed with an indentation portion 58*f* for detecting the origin position of rotation, and a first edge 58*g* and a second edge 58*h* on either side of the indentation portion 58*f*. The first edge 58*g* is formed with a relatively soft gentle and the second edge 58*h* is formed with a relatively steep slope.

The rotor 51*c* and the cam gear 58 are attached with the surface provided with the first protrusion 97 and the second protrusion 98 facing and stacked on the surface provided with the third protrusion 58*d* and the fourth protrusion 58*e*. The gear teeth 58*a* and the pump gear 90 are supported coaxially so that they can simultaneously or alternately meshingly engage with the planetary gear 59 when abutted by the planetary gear 59.

Figure 13A:
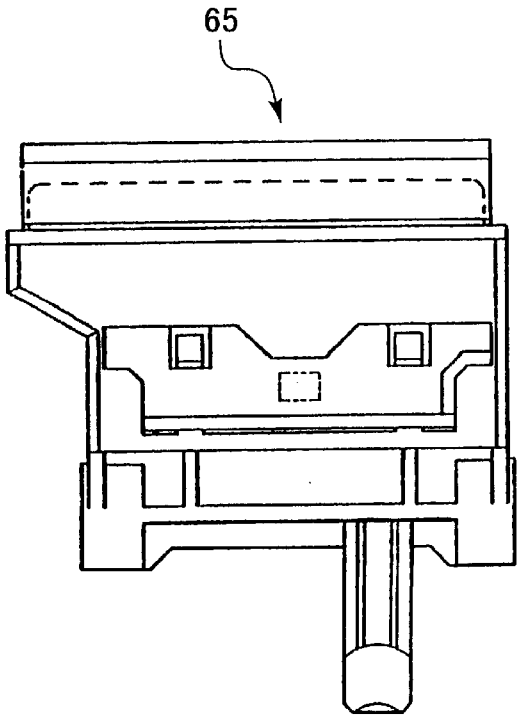
FIGS. 13(*a*) to 13(*c*) show a wiper member.
Figure 13B:
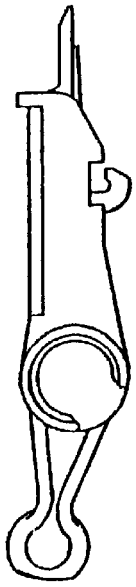
Figure 13C:
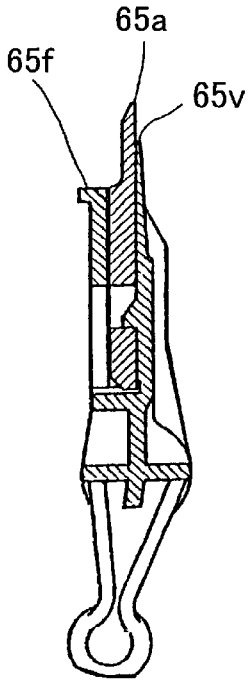
Figure 14A:
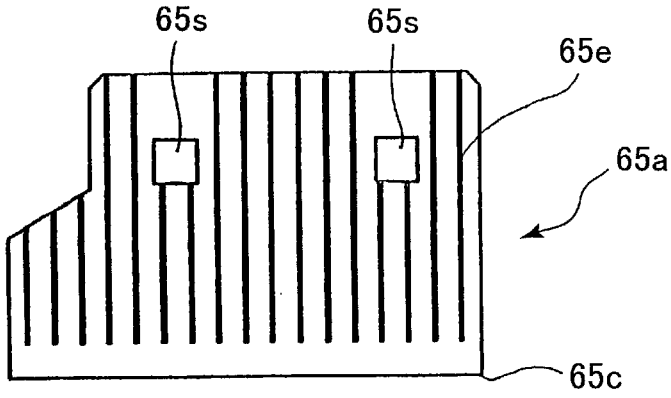
FIGS. 14(*a*) to 14(*e*) show a blade of the wiper member.
Figure 14B:
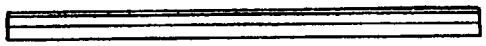
Figure 14C:
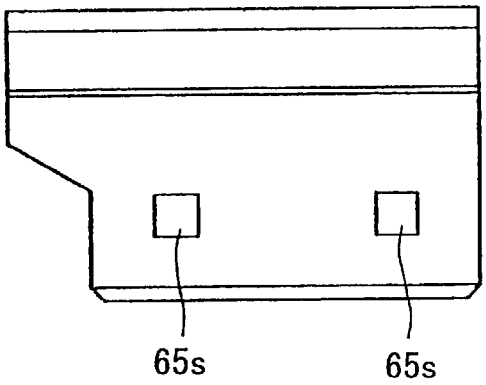
Figure 14D:
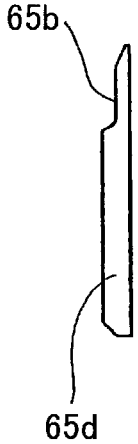
Figure 14E:
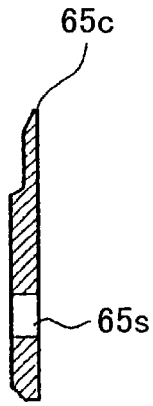

FIGS. 13(*a*) to 15(*c*) show configuration of the wiper member 65. The wiper member 65 is configured from a rubber blade 65*a* and a blade holder 65*f*.

As shown in FIGS. 14(*a*) to 14(*e*), the rubber blade 65*a* is formed from an integral plate of synthetic rubber with a relatively thick main portion 65*d* connected to a relatively thin portion 65*b*. The tip of the thin portion 65*b* has a tip portion 65*c* formed into a point.

The side surface of the thin portion 65*b* is formed flush with the side surface of the main portion 65*d*. Grooves 65*e* are formed in this flush side surface. The grooves 65*e* are formed across the main portion 65*d* in parallel with the vertical direction to a position several millimeters from the tip portion 65*c*. The main portion 65*d* is formed with an attachment holes 65*s* for attaching and supporting to the blade holder 65*f*.

Figure 15A:
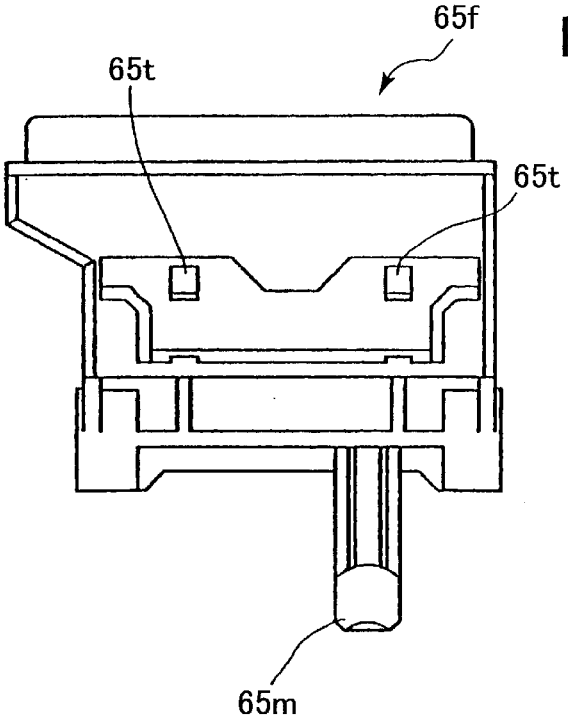
FIGS. 15(*a*) to 15(*c*) show the blade of the wiper member.
Figure 15B:
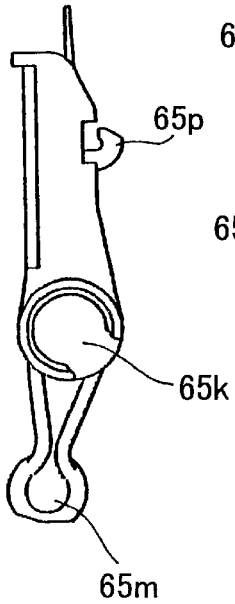
Figure 15C:
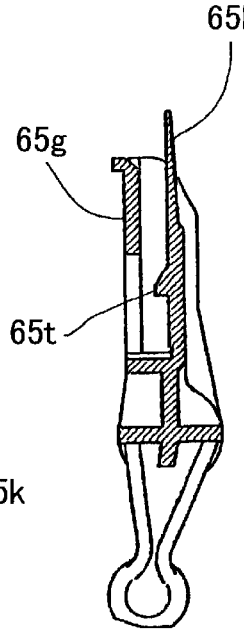

As shown in FIGS. 15(*a*) to 15(*c*), the blade holder 65*f* includes a front wall 65*h* and a rear wall 65*g*, which are supported in parallel with each other, a rotational shaft 65*k*, which is formed below the front and rear walls 65*h*, 65*g*, and an actuator 65*m*, which is provided below the rotational shaft 65*k*.

The rubber blade 65*a* is inserted between the front and rear walls 65*h*, 65*g* so that the side wall of the rubber blade 65*a* faces the front wall 65*h* A hold portion 65*t*, which protrudes from the front wall 65*h* toward the rear wall 65*g*, enters into the attachment holes 65*s* and supports the rubber blade 65*a* to the blade holder 65*f*.

The front wall 65*h* is somewhat higher than the rear wall 65*g*. Also, when the rubber blade 65*a* is supported between the front and rear walls 65*h*, 65*g*, at least one millimeter of the thin portion 65*b*, that is, from the tip portion 65*c*, protrudes above the rear wall 65*g*. An ink holding portion 65*v* (see FIG. 13(*c*)) for supporting ink by capillary action is formed between where the front wall 65*h* and the rubber blade 65*a* contact each other. The ink holding portion 65*v* is formed to prevent the ink from leaking out. The ink holding portion 65*v* is formed from a space capable of supporting ink by capillary action and also capable of preventing leaks, and desirably includes a porous member, such as activated charcoal or sponge, capable of absorbing ink or one or more sheets of film material disposed in the space.

As shown in FIG. 15(*b*), a hook 65*p* is formed in the front wall 65*h* at the side opposite from the rear wall 65*g*. A spring 66 is attached at one end to the hook 65*p* and at the other end to the pump unit frame 55. The spring 66 pulls on the hook 65*p* so that the portion of the wiper member 65 above the rotational shaft 65*k* is urged in the direction in which the spring pulls. The actuator 65*m* is provided at the end of the blade holder 65 opposite from the hook 65*p*, with the rotational shaft 65*k* sandwiched therebetween. The rotational shaft 65*k* is rotatably supported on the pump unit frame 55. The actuator 65*m* is urged in the direction opposite to the direction in which the spring pulls the hook 65*p*.

Figure 16A:
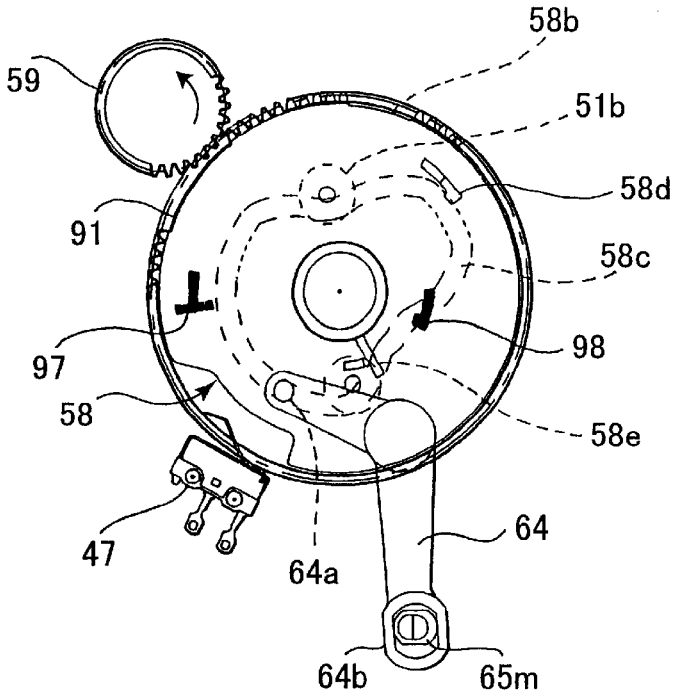
FIG. 16(*a*) is an explanatory diagram illustrating the operation of the buffer purge pump.
Figure 16B:
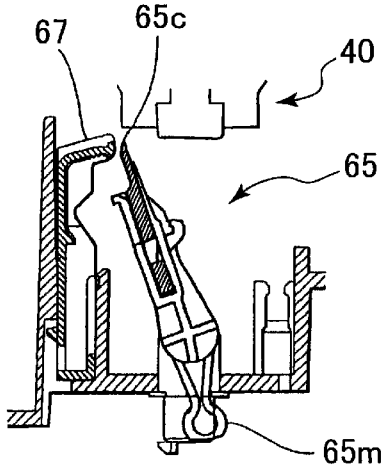

As shown in FIG. 16(*a*), a pin 64*a* provided at one end of a link 64 is fitted into the cam groove 58*c*. Operation of the pin 65*a* and the cam groove 58*c* drive the wiper member 65 to move reciprocally from the position shown in FIG. 20(*b*) to the position shown in FIG. 21(*b*) and then back to the position shown in FIG. 20(*b*). Said differently, the position shown in FIG. 21(*b*) is the starting point for the first half of the reciprocal movement and the end point for the second half of the reciprocal movement, and the position shown in FIG. 20(*b*) is the end point for the first half of the reciprocal movement and the start point for the second half of the reciprocal movement.

As will be described in detail later, the wiper blade 65 is driven by cam groove 58*c* formed in the cam gear 58. Rotation of the cam gear 58 rotates the cam groove 55*c*. The link 64 swings back and forth in association with the shape of the cam groove 58*c*. The swinging movement of the link 64 is transmitted to the actuator 65*m* so that the wiper member 65 swings back and forth centered on the rotational shaft 65*k*. The wiper member 65 is in a stopped condition when, as shown in FIG. 16(*a*), the pin 64*a* provided at one end of the link 64 is engaged with the arc-shaped portion of the cam groove 58*c* that is concentric with the rotational center shaft of the cam gear 58 and the non-geared portion 91 of the cam gear 58 faces the planetary gear 59. Also, the wiper member 65 is driven so that the tip portion 65*c* moves leftward and rightward as viewed in FIG. 16(*b*) when the pin 64*a* moves in the can groove 58*c* to a position closer to the center rotational shaft.

Figure 11A:
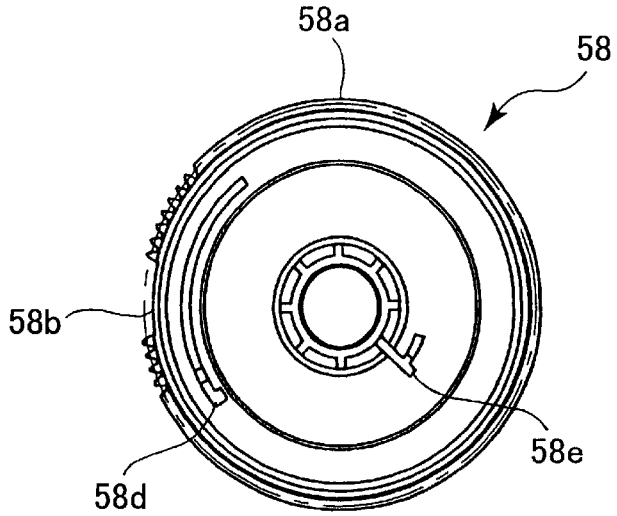
FIGS. 11(*a*) to 11(*c*) show a cam gear.
Figure 11B:
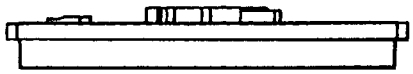
Figure 11C:
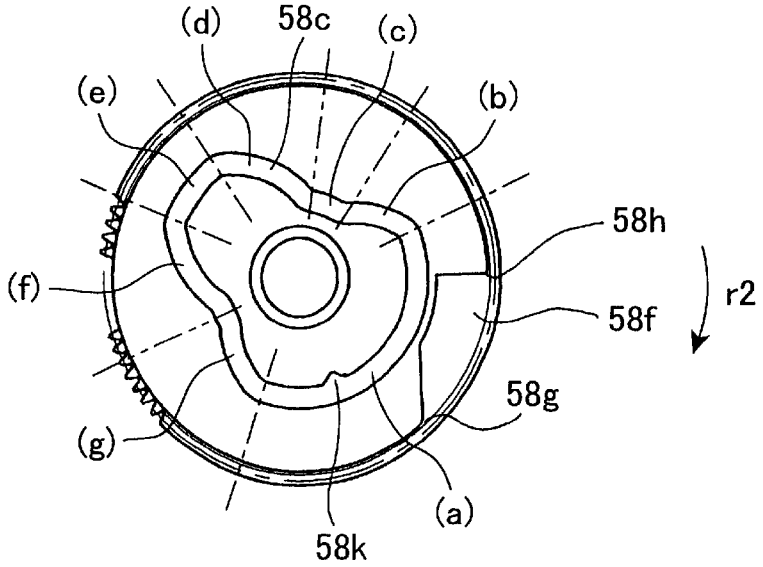

That is, as shown in FIGS. 11(*a*) to 11(*c*), the cam groove 58*c* can be divided into seven different sections (a) to (g). Portions of the cam groove 58*c* furthest from the rotational center shaft of the cam gear 58 move the wiper member 65 to the left as indicated in FIG. 19(*a*), which shows the start point of the first half, and the end point of the second half, of wiper member's reciprocal movement. Contrarily, portions of the cam groove 58*c* closes to the rotational center shaft of the cam gear 58 move the wiper member 65 to the right as indicated in FIG. 19(*b*), which shows the end point of the first half, and the start point of the second half, of wiper member's reciprocal movement.

The cam section (a) is a relatively long arc-shaped section provided concentric with the rotational center shaft of the cam gear 58 and is provided nearest the outer periphery of the cam gear 58. When the pin 64*a* is located at cam section (a), the positional of the pin 4*a* will not change in relation to central rotational shaft of the cam gear 58*a* even when the cam gear 58 rotates in the direction indicated by arrow r2. Therefore the wiper member 65 will remain stopped in the waiting position.

The cam section (b) is located nearer the rotational center shaft of the cam 58 than the cam section (a). When the pin 64*a* is located in the cam section (b) and the cam gear 58 rotates in the direction indicated by arrow r2, then the pin 64*a* moves nearer the rotational center shaft of the cam gear 58*a*, thereby moving the wiper member 65 to the right as viewed in FIG. 19(*b*), that is, to the end point of the first half, and the start point of the second half, of wiper member's reciprocal movement.

The cam section (c) is relatively short section that is nearest to the rotational center shaft and concentric with the rotation center shaft. When the pin 64*a* is located in the cam section (c) the position of the pin 64*a* with relation to the rotational center shaft of the cam gear 58*a* will not change even if the cam bear 58 rotates in the direction indicated by the arrow r2. Therefore the wiper member 65*a* will remain stationary.

The cam section (d) connects the cam section (c), which is the closes section to the rotational center shaft, with the cam section (e), which is the cam section separated the furthest from the rotational center shaft. As a result, the wiper member 65 moves the most when the pin 64*a* passes through the cam section (d). When the pin 64*a* is located in the cam section (d) and the cam gear 58 rotates in the direction indicated by arrow r2, the pin 64*a* separates from the rotational center shaft of the cam gear 58*a*. Therefore, the wiper member 65 moves to the left as viewed in FIG. 19 (a), that is, to the start point of the first half, and the end point of the second half, of wiper member's reciprocal movement.

The cam section (e) is a relatively short cam section separated the furthest from the rotational center shaft and concentric with the rotational center shaft. When the pin 64*a* is located in the cam section (e), the position of the pin 64*a* with relation to the rotational center shaft of the cam gear 58*a* will not change even if the cam bear 58 rotates in the direction indicated by the arrow r2. Therefore the wiper member 65*a* will remain stationary.

The cam section (f) travels from the cam section (e) to closer to the rotational center shaft. When the pin 64*a* is located in the cam section (f) and the cam 58 rotates in the direction indicated by arrow r2, then the pin 64*a* approaches the rotational center shaft of the cam gear 58*a*, so that the wiper member 65 moves to the right as viewed in FIG. 19(*b*), that is, to the end point of the first half, and the start point of the second half, of wiper member's reciprocal movement.

The cam section (g) connects the end of the cam section (f) to the end of the cam section (a). When the pin 64*a* is located in the cam section (g) and the cam gear 58 rotates in the direction indicated by arrow r2, the pin 64*a* separates from the rotational center shaft of the cam gear 58*a*. Therefore, the wiper member 65 moves to the left as viewed in FIG. 19(*a*), that is, to the start point of the first half, and the end point of the second half, of wiper member's reciprocal movement.

Also, as shown in FIGS. 16(*a*) and 16(*b*), the pin 64 is engaged in the cam groove 58*c*. Also, the actuator 65*m* is engaged with the other end 64*b* of the link 64 from the end provided with the pin 64*a*.

A blade cleaner 67 is disposed at the start point of the first half, and the end point of the second half, of wiper member's reciprocal movement. The blade cleaner 67 is for cleaning ink that clings to the tip portion 65*c* of the rubber blade 65*a*. It should be noted that the position of the rubber blade 65*a* shown in FIG. 16, that is, where the tip portion 65*c* of the rubber blade 65*a* just exceeds the blade cleaner 67 during the second half of the wiper member's reciprocal movement, is referred to as the waiting position.

The tip portion 65*c* of the wiper member 65 wipes the nozzle surface of the ink jet head 40 from the waiting position shown in FIG. 19(*a*) to the end point of the second half shown in FIG. 19(*b*). As a result, as shown in FIG. 19(*a*), ink clinging to the nozzle surface of the ink jet head 40 clings to the surface of the tip portion 65*c* nearest the front wall 65*h*. The clinging ink moves to the space between the rubber blade 65*a* and the front wall 65*h* and is held in the ink holding portion 65*v* by capillary action. The amount of ink clinging to the tip portion 65*c* is reduced compared to directly after the wiping operation was completed.

The rear wall 65*g* is formed to a height, and the thin portion 65*b* is formed with a thickness and length, adjusted to produce an appropriate abutment force against the nozzle surface when the wiper member 65 wipes the nozzle surface of the ink jet head 40. Further, the front wall 65*h* is formed with a height appropriate to rapidly move ink that clings to the tip portion 65*c* to the ink holding portion 65*v*, without interfering with the nozzle surface.

Further, as shown in FIG. 19(*b*), the thin portion 65*b* of the rubber blade 65*a* bends while contacting the nozzle surface of the ink jet head 40 during movement of the wiper member 65 from the waiting position indicated by two-dot chain line to the end of the first half of the reciprocal movement indicated by solid line. When the thin portion 65*b* bends, a gap opens between the thin portion 65*b* and the front wall 65*h*. The ink held near the tip of the front wall 65*h* moves down into the gap.

The blade cleaner 67 cleans the tip portion 65*c* of the surface of the rubber blade 65*a* scrapes across the protrusion portion 67*b* at the inner surface of the blade cleaner 67, thereby cleaning off the slight amount of ink clinging to the tip portion 65*c* of the rubber blade 65*a*. The cleaned-off ink moves down the inner surface of the top plate 67*a*, which slants downward away from the movement of the tip portion 65*c* of the rubber blade 65*a*, and further downward to the support portion 67*d* by way of the back plate 67*c*.

The support portion 67*d* is formed with an opening 67*f* as shown in FIG. 22(*a*). Ink that flows down the back plate 67*c* flows through the opening 67*f* to an absorption member (not shown). An absorption member, made from urethane foam for example, could be provided within the support portion 67*d* instead.

Next, operation of the wiper member 65 and the buffer purge pump 51 will be explained in detail.

FIGS. 16(*a*) to 29(*d*) show a single cycle of operations involving the buffer purge pump 51, the cam gear 58, and the wiper member 65.

FIGS. 16(*a*) and 16 (b) show the cam gear 58 and the wiper member 65 in a position (0). In position (0), the gears 58*a* of the cam gear 58 are meshingly engaged with the planetary gear 59. However, in position (0), the non-geared portion 91 of the pump gear 90 faces the planetary gear 59, so the pump gear 90 is not in meshing engagement with the planetary gear 59. Also, the pin 64*a* provided to one end of the link 64 is engaged in the cam groove 58*c* of the cam gear 58 in an arc-shaped portion that is concentric with the center of the cam gear 58. Accordingly, in the position (0), when the planetary gear 59 rotates in the direction indicated by an arrow in FIG. 16(*a*), only the cam gear 58 will rotate in the clockwise direction as viewed in FIG. 16(*a*). Because the pump gear 90 will not rotate, the rotor 51*c* and the pressurizing member 51*b* will not rotate. As a result, the buffer purge pump 51 will remain in a stopped condition, that is, with the tube member 51*a* closed shut so that ink flow is not generated in the buffer purge tube 50. Also, the pin 64*a* is engaged in the cam section (a) of the cam groove 58*c*, so that the wiper member 65 is stopped in the waiting position.

In the position (0), the ink jet head 40 and the wiper member 65 will not contact each other even if the ink jet head 40 moves above the wiper member 65. When the ink jet head 40 is to be wiped, the ink jet head 40 is moved to the wipe position, so that the wiping member 65 can wipe the ink jet head 40.

Figure 17:
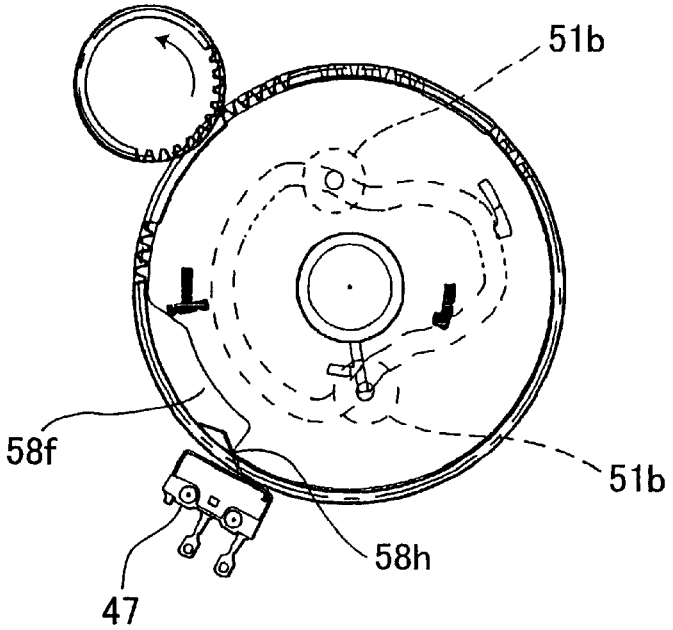
FIG. 17 is an explanatory diagram illustrating the operations of the buffer purge pump and the wiper member.
Figure 18A:
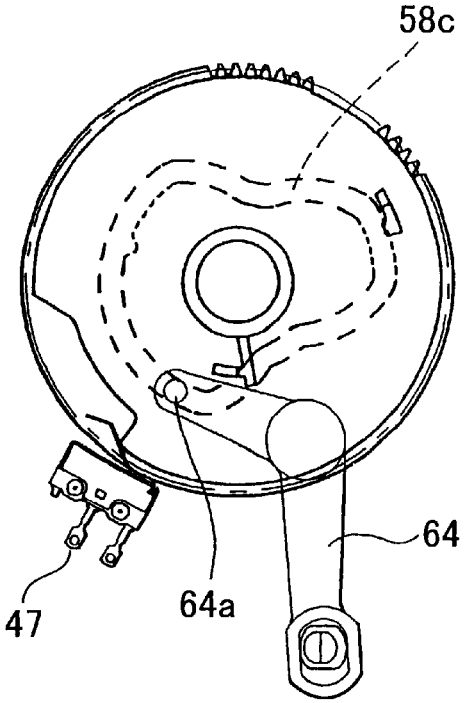
FIG. 18(*a*) shows the cam gear in a position (1)
Figure 18B:
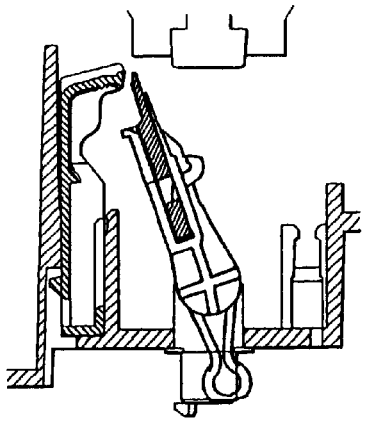

FIGS. 17 and 18 show a position (1) entered when the planetary gear 59 rotates the cam gear 58 by 19.06 degrees from the position (0). At this time, the actuator of the origin sensor 47 abuts against the second edge 58*h*, thereby detecting the origin of the can gear 58. In this condition also, drive force from the planetary gear 59 will not be transmitted to the pump gear 90, so the pump gear 90 remains stationary. Accordingly, the buffer purge pump 51 remains in a stopped condition. As is clear by comparing FIGS. 16(*a*) with 18(*a*), the pin 64*a* provided to one end of the link 64 remains engaged in the cam groove 58*c* of the cam gear 58 at an arc-shaped section that is concentric with the gear center. Accordingly, the wiper member 65 remains in the waiting position.

Figure 20A:
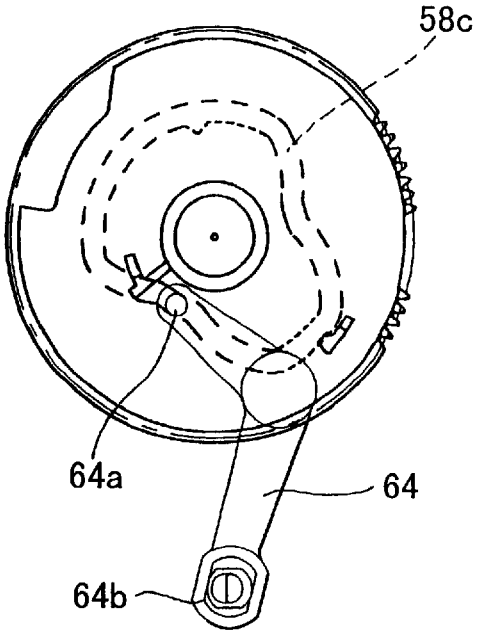
FIG. 20(*a*) shows the cam gear in a position (2)
Figure 20B:
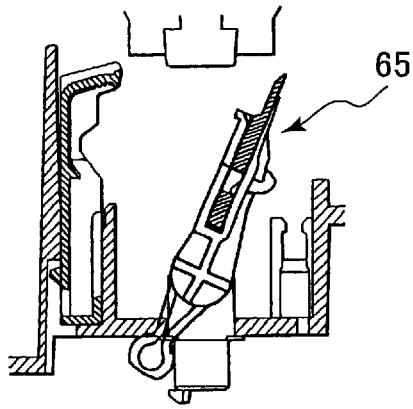

FIGS. 20(*a*) and 20(*b*) show a position (2) entered when the cam gear 58 rotates by 62.73 degrees from position (1). The planetary gear 59 rotates only the cam gear 58 between the position (1) and the position (2). The pump gear 90 remains stationary with the same orientation. The pin 64*a* is in meshing engagement with the cam section (b) of the cam groove 58*c* from the position (1) shown in FIG. 18 to the position (2) shown in FIG. 20. Because the cam section (b) approaches the center shaft of the cam gear 58, the pin 64*a* engaged in the cam groove 58*c* approaches the central shaft, so that the other end 64*b* of the link 64 swings to the left as viewed in FIG. 20(*b*). The tip portion 65*c* of the wiper member 65 swings from the waiting position to the end of the first half of the wiper's reciprocal movement.

As shown in FIG. 19(*b*), the tip portion 65*c* of the wiper member 65 wipes the nozzle surface of the ink jet head 40 when the wiper member 65 moves from the waiting position indicated by dotted chain line in FIG. 19(*a*) to the end of the first half of the wiper's reciprocal movement shown in solid line in FIG. 19(*b*). The wiping operation transfers the ink from the nozzle surface of the ink jet head 40 to the rubber blade 65*a*, so that the ink clings to near the tip portion 65*c* of the rubber blade 65*a* on the surface of the rubber blade 65*a* nearer the front wall 65*h*. This clinging ink is drawn in between the rubber blade 65*a* and the front wall 65*h* by the grooves 65*e* and held there by capillary action.

In the position (2), the pin 64*a* is engaged in the cam section (c) of the cam groove 58*c*. The cam section (c) of the cam groove 58*c* is the section nearest to the rotational center shaft and is concentric with the rotation center shaft. Therefore, the wiper member 65 can be stably supported at the end of the first half, which is the start of the second half, of the wiper's reciprocal path. As will be explained later, at this position the ink supply motor 88*a* is temporarily stopped and the ink jet head 40 is retracted to a position where it will not be contacted by the tip portion 65*c* of the wiper member 65 even if the wiper member 65 is driven to move reciprocally.

Figure 21A:
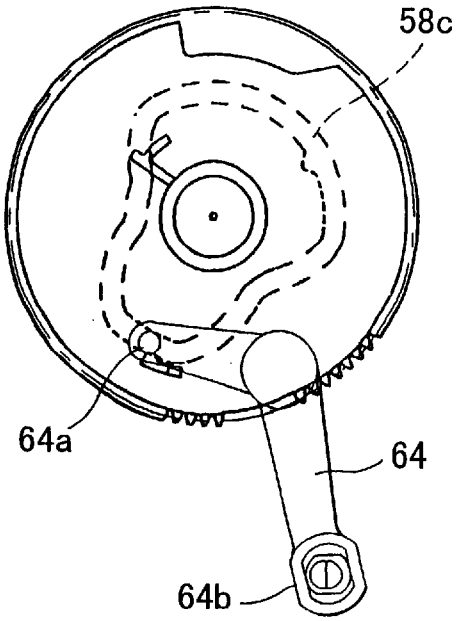
FIG. 21(*a*) shows the cam gear in a position (3)
Figure 21B:
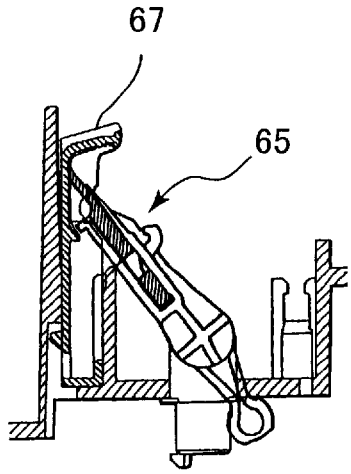

FIGS. 21(*a*) and 21(*b*) show a position (3) entered when the cam gear 58 is rotated by 71.59 degrees from the position (2). Said differently, the position (2) is 134.32 degrees from the position (1), which is the origin position. From the position (2) to the position (3), the rotational drive of the planetary gear 59 rotates only the cam gear 58 and the pump gear 90 continues to remain stationary. The pin 64*a* is engaged in the cam section (d) of the cam groove 58*c* from the position (2) shown in FIGS. 20(*a*) and 20(*b*) to the position (3) shown in FIGS. 21(*a*) and 21(*b*). Because the cam section (d) moves away from the center shaft of the cam gear 58, the pin 64*a*, which is engaged in the cam groove 58*c*, moves away from the center shaft of the cam gear 58, so that the other end 64*b* of the link 64 switches to the right as viewed in FIG. 21(*a*). As a result, the tip portion 65*c* of the wiper member 65 switches from the start to the end of the second half of the wiper's reciprocal movement. At this time, the surface of the rubber blade 65*a* that does not contact the nozzle surface of the ink jet head 40 contacts and passes over the protrusion portion 67*b* of the top plate 67*a* of the blade cleaner 67 and moves into the position (3) shown in FIG. 21(*b*).

While in the position (3), the pin 64*a* is engaged in the cam section (e). Because the cam section (e) is separated the furthest from the rotational center shaft and concentric with the rotational center shaft, the wiper member 65 can be stably supported at the end position of the second half of the wiper's reciprocal movement. Also, the wiper member 65 abuts against the blade cleaner 67. The surface of the rubber blade 65*a* that did not contact the nozzle surface of the ink jet head 40 is supported in contact with the blade cleaner 67.

Figure 23A:
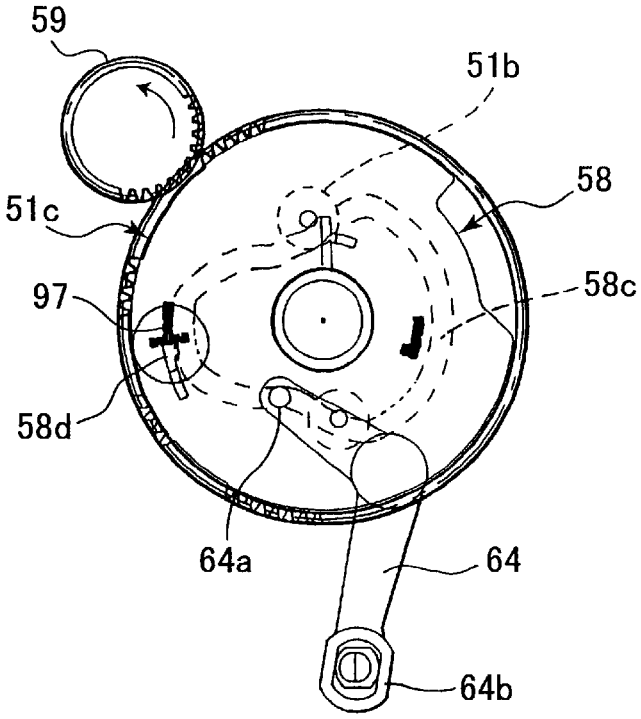
FIG. 23(*a*) shows the cam gear further rotated from the position (3)
Figure 23B:
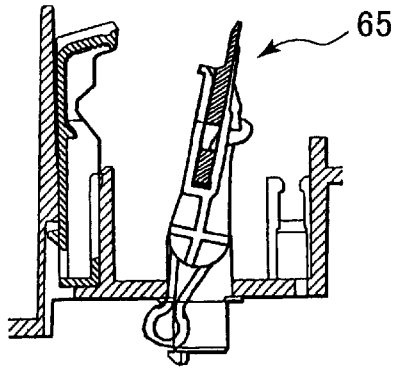

FIG. 23(*a*) shows the cam gear 58 rotated by 54.55 degrees from the position (3), that is, by 188.87 degrees from the origin. In this position, the pin 64*a* is engaged in the cam section (f) of the cam groove 58*c*, so that the blade member 65 has moved partially into the first half of the wiper's reciprocal movement as shown in FIG. 23(*b*). During this time, as shown in FIG. 22(*b*), the blade cleaner 67 cleans tip portion 65*c*, which contacted the nozzle surface.

If a film, a porous member, or other element capable of holding ink is inserted into the ink holding portion 65*v* between the rubber blade 65*a* and the front wall 65*h*, then ink held in the ink holding portion 65*v* will not scatter when the thin portion 65*b* of the rubber blade 65*a* resiliently recovers from the bend condition indicated in solid line in FIG. 22(*b*) to the position indicated by two-dot chain line in FIG. 22(*b*), where the processes of wiping the nozzle surface of the ink jet head 40 are completed. When rotational drive of the planetary gear 59 rotates the cam gear 58 in the clockwise direction from the orientation shown in FIG. 23(*a*), the third protrusion S8*d* abuts against the first protrusion 97 of the pump gear 90 (the rotor 51*c*). Up until this time, the pump gear 90 has remained stationary. Because of the abutment between the third protrusion 58*d* of the cam gear 58 against the first protrusion 97, further drive force of the planetary gear 59 is transmitted to the pump gear 90, not only to the cam gear 58, through the first protrusion 97. That is, the cam gear 58 and the pump gear 90 (the rotor 51*c*) rotate together. As a result, the pressurizing members 51*b* start rotating in the clockwise direction as viewed in FIG. 23(*a*). Therefore, the buffer purge pump 51 stars generating ink flow in the buffer purge tube 50 from the buffer tank 20 toward the sub-tank 12.

Figure 24A:
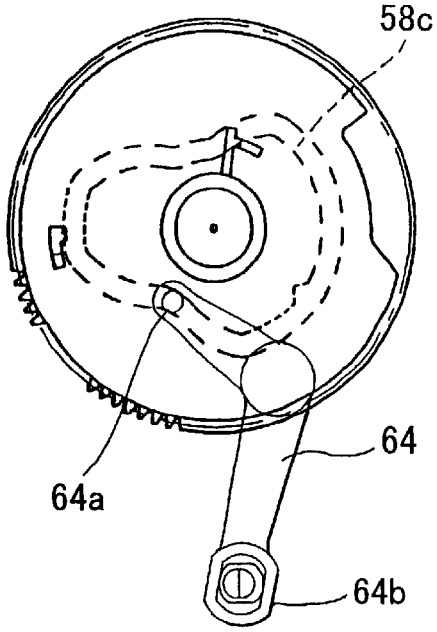
FIG. 24(*a*) shows the cam gear in a position (4)
Figure 24B:
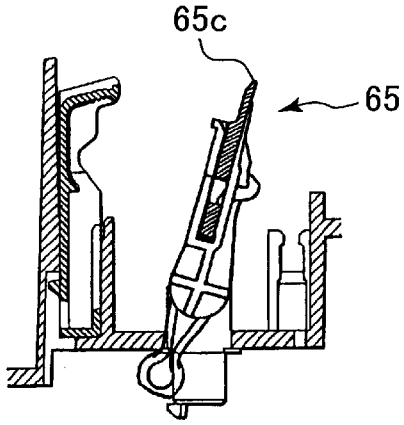

FIG. 24(*a*) shows a position (4) entered when the drive force of the planetary gear 59 rotates the cam gear 58 and the pump gear 90 (rotor 51*c*) by 8.87 degrees from the orientation of FIG. 23(*a*), that is by 197.74 degrees from the origin. The cam gear 58 and the pump gear 90 (rotor 51*c*) rotate together from the orientation of FIG. 23(*a*) to the position (4) shown in FIG. 24(*a*). That is, the buffer purge pump 51 operates and also the pin 64*a* moves slightly toward the rotational center shaft of the cam gear 58 by rotation of the cam groove 50*c*. The tip 65*c* of the wiper member 65 moves completely to the right as viewed in FIG. 24(*b*), thereby completing a wiper cleaning operation.

Figure 25A:
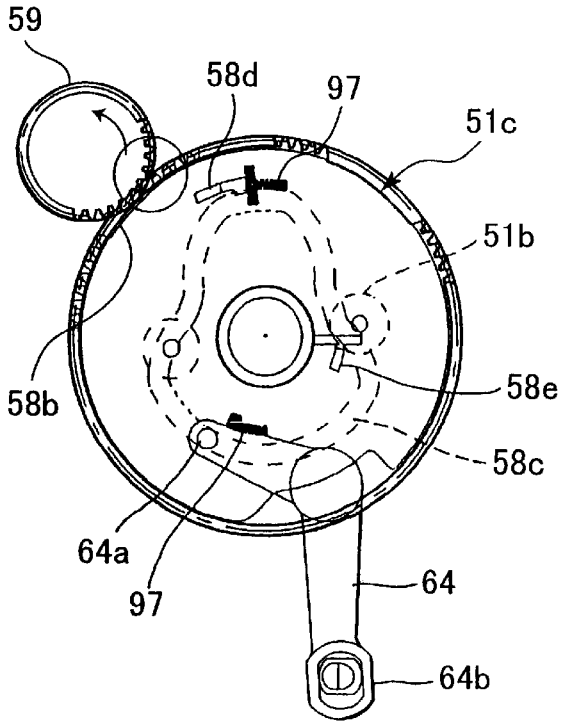
FIG. 25(*a*) shows the cam gear further rotated from the position (4)
Figure 25B:
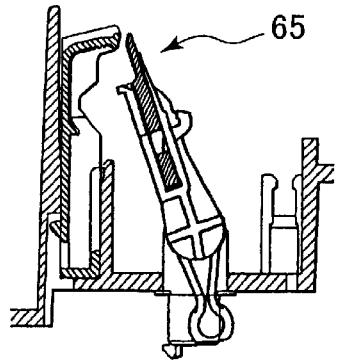

FIG. 25(*a*) shows the orientation of the cam gear 58 and the pump gear 90 (rotor 51*c*) after drive force of the planetary gear 59 rotates the cam gear 58 and the pump gear 90 by 81.58 degrees from the position (4), that is, by 279.32 degrees from origin. In between the position (4) to the orientation shown in FIG. 25(*a*), both the cam gear 58 and the pump gear 90 (rotor 51*c*) rotate in meshing engagement with the planetary gear 59. Also the wiper member 65 returns to the waiting position.

Also, in the condition shown in FIG. 25(*a*), the non-geared portion 58*b* of the cam gear 58 faces the planetary gear 59. In contrast to this, the pump gear 90 is in meshing engagement with the planetary gear 59. As a result, the drive force of the planetary gear 59 continues to rotate the pump gear 90 (rotor 51*c*) and the first protrusion in the clockwise direction as viewed in FIG. 25(*a*). In contrast to this, the drive force of the planetary gear 59 is no longer transmitted to the cam gear 58, so the cam gear 58 is no longer rotated in the clockwise direction as viewed in FIG. 25(*a*). Therefore, the third protrusion 58*d* does not rotate in the clockwise direction as viewed in FIG. 25(*a*). Accordingly, only the buffer purge pump 51 continues to operate.

Figure 26A:
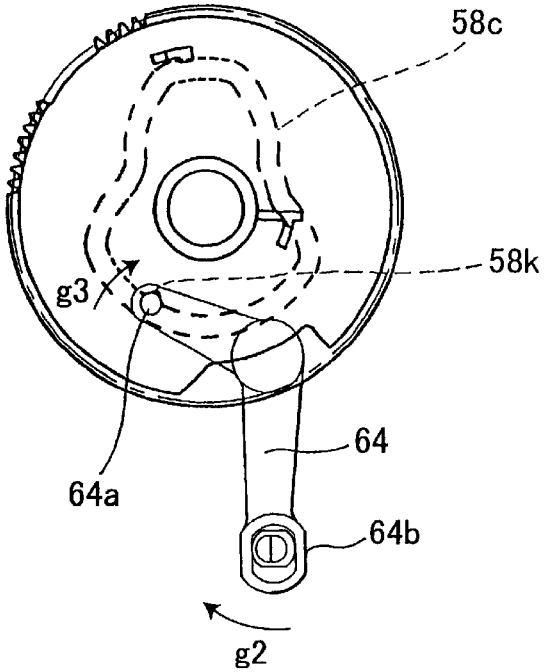
FIG. 26(*a*) shows the cam gear further rotated from the position in FIG. 25(*a*)
Figure 26B:
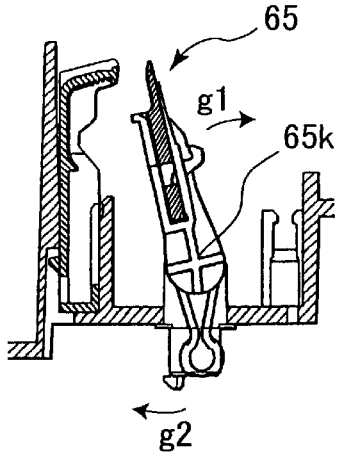

FIG. 26(*a*) shows the orientation of the cam gear 58 after the cam gear 58 separates from engagement with the planetary gear 59 and rotates by 2.5 degrees from the position of FIG. 25. As shown in FIG. 26(*b*), the wiper member 65 is urged to move in the direction of arrow g1 by the spring 66 shown in FIG. 8. The rotational shaft 65*k* converts this urging force into urging force of the actuator 65 in the direction indicated by arrow g2. The urging force in the direction of arrow g3 operates on the pin 64*a* so that the pin 64*a* moves through the cam groove 58*c*.

A notch 58*k* is formed in a portion of the arc-shaped cam section (a) of the cam groove 58*c*. The notch 58*k* is a v-shaped cut-out portion and is for positioning the wiper member 65 in the waiting position. In the condition shown in FIG. 26(*a*), the pin 64*a* is engaged in the notch 55*k* of the cam groove 58*c*, so that rotation of the cam gear 5 can be reliably stopped and swinging movement of the cam gear 58 can be suppressed.

In the condition shown in FIG. 25(*a*), and also in FIG. 38(*b*), an urging force is generated by the pin 64*a* against the slanting surface of the V-shaped notch 58*k*. Because of this urging force, the center of the V-shaped notch 58*k* attempts to engage with the pin 64*a*, so that the cam gear 58 rotates from the orientation shown in FIG. 25(*a*) to the condition shown in FIG. 26(*a*).

Figure 27A:
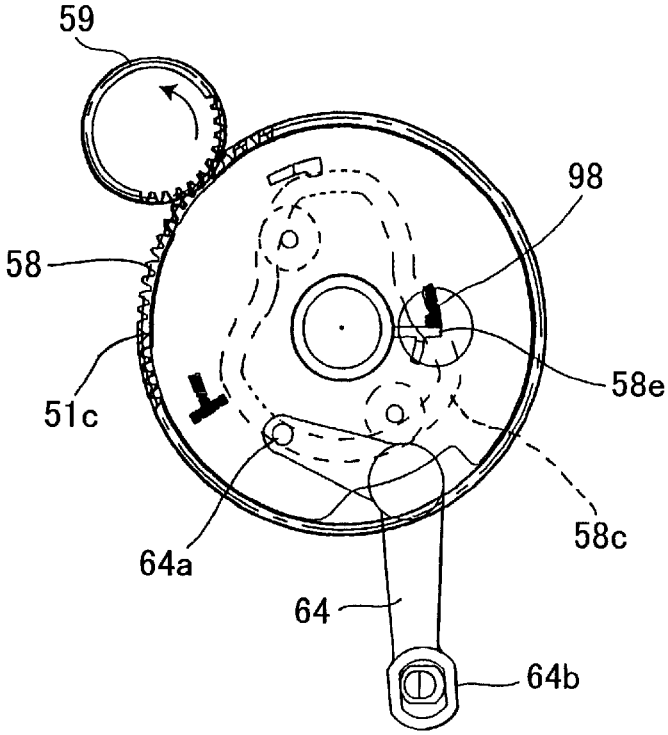
FIG. 27(*a*) shows the cam gear further rotated from the position in FIG. 26(*a*)
Figure 27B:
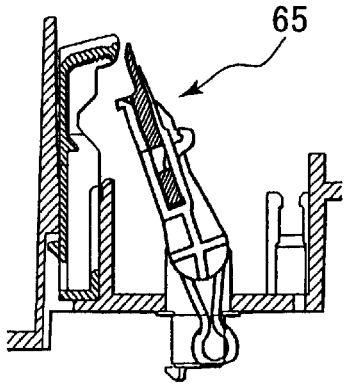

FIG. 27(*a*) shows the pump gear 90 after drive force of the planetary gear 59 rotates the pump gear 90 by 245.45 degrees from the condition shown in FIG. 25(*a*), that is, by 534.77 degrees from the origin. Rotational drive force from the planetary gear 59 is applied to only the pump gear 90 from the condition shown in FIG. 26(*a*) to the condition shown in FIG. 27(*a*). As a result, only the buffer purge pump 51 operates.

The cam gear 58 remains stationary during further rotation of the pump gear 90 shown in FIGS. 25(*a*) to 28(*b*). Accordingly, the third protrusion 58*d* and the fourth protrusion 58*e* remain stationary. On the other hand, the pump gear 90 (rotor 51*c*) rotates, so that the first protrusion 97 and the second protrusion 98 rotate. Accordingly, the abutment between the third protrusion 58*d* and the first protrusion 97 is released and the third protrusion 58*d* and the first protrusion 97 separate from each other. The second protrusion 98, which rotates with rotation of the pump gear 90 (rotor 51*c*), abuts against the fourth protrusion 58*e* of the cam bear 58 in the condition shown in FIG. 27(*a*). The second protrusion 98 pushes against the fourth protrusion 58*e* as shown in FIGS. 27(*a*) and 28(*a*), so that rotational drive force applied from the planetary gear 59 to the pump gear 90 (rotor 51*c*) is transmitted to the cam gear 58. As a result, the pump gear 90 (rotor 51*c*) and the cam gear 58 rotate together.

Figure 28A:
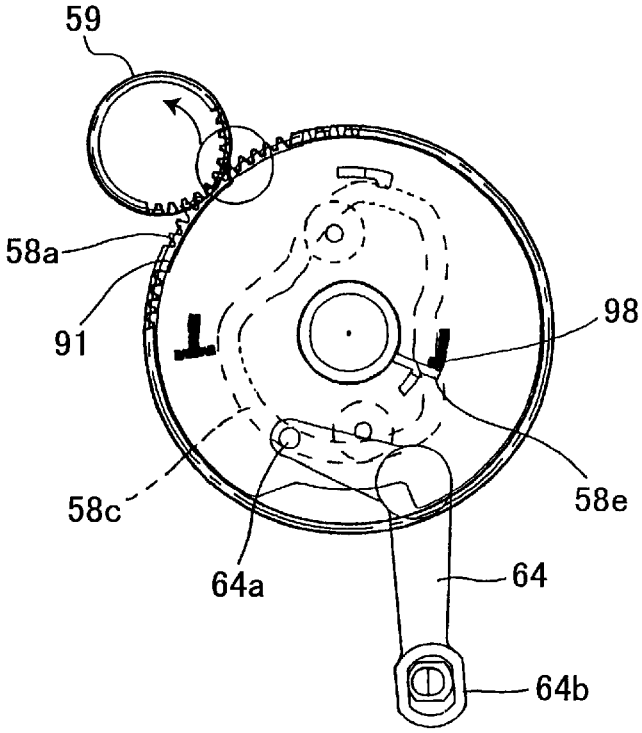
FIG. 28(*a*) shows the cam gear where the pump gear is disengaged from the planetary gear.
Figure 28B:
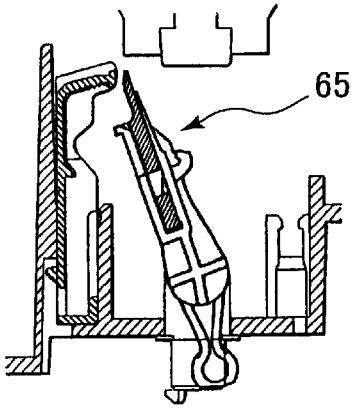

FIG. 28(*a*) shows condition after the drive force from the planetary gear 59 rotates the cam bear 58 and the pump gear 90 (rotor 51*c*) by 24.1 degrees from the condition shown in FIG. 27(*a*), that is, by 548.87 degrees from origin. From the condition shown in FIG. 27(*a*) to the condition shown in FIG. 28(*a*), the fourth protrusion 58*e* urges the second protrusion 98 of the pump gear 90 (rotor 51*c*) so that the pump gear 90 also rotates. During this time, the gears 58*a* of the cam gear 58 come into meshing engagement with the planetary gear 59. The wiper member 65 remains in the waiting position because of the shape of the cam groove 58*c*.

In the condition shown in FIG. 28(*a*), the non-geared portion 91 of the pump gear 90 confronts the planetary gear 59, so that meshing engagement between the pump gear 90 and the planetary gear 59 is released. Afterwards, only the cam gear 58, which is in engagement with the planetary gear 59, rotates and the pump gear 90 does not rotate.

After the drive force from the planetary gear 59 rotates only the cam gear 58 by 56.58 degrees from the condition shown in FIG. 28(*a*), that is, by 605.45 degrees from origin, the cam gear 58 and the pump gear 90 return to the position (1), which is the origin.

Figures 29A, 29B, 29C, 29D:
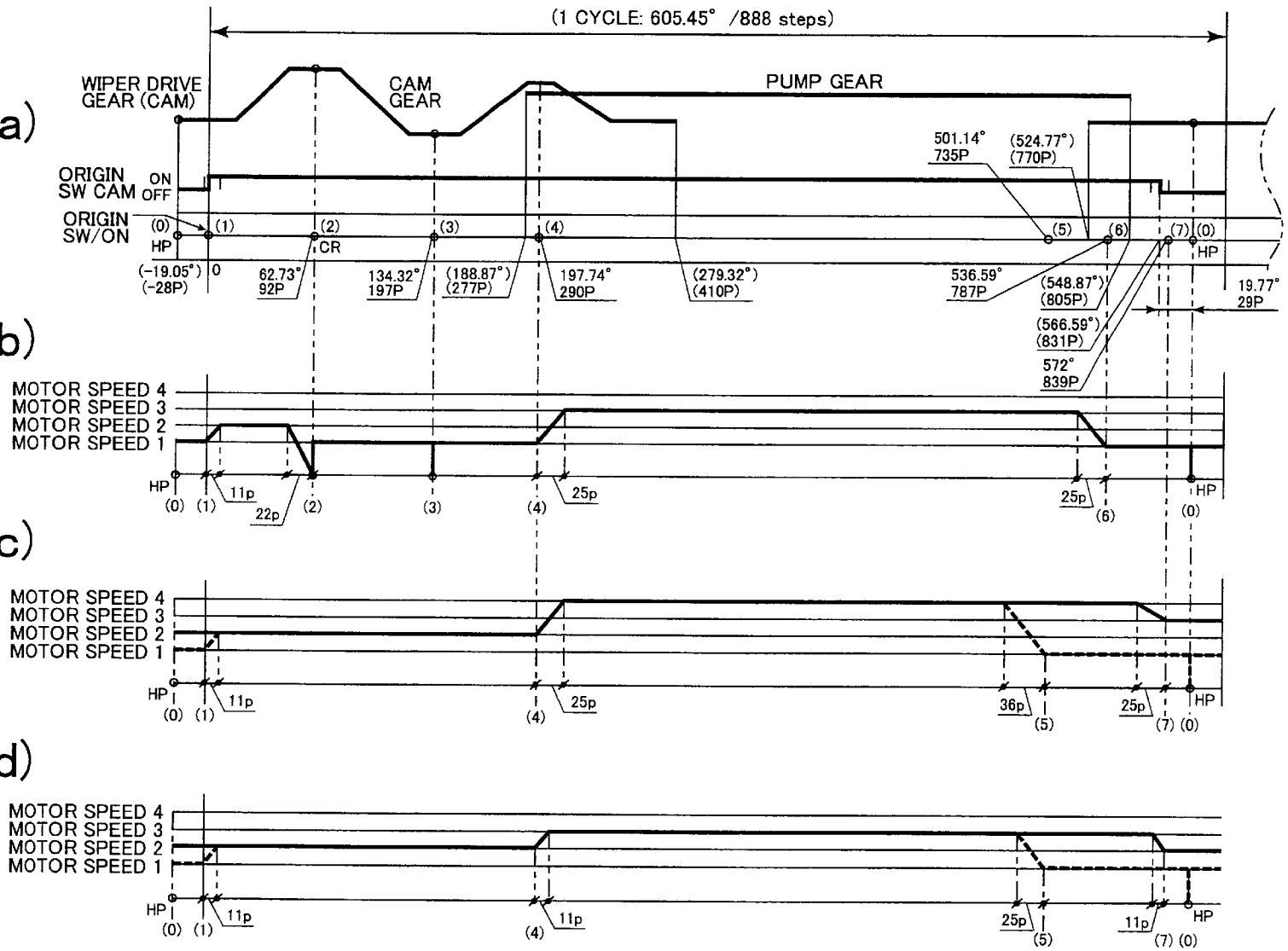
FIG. 29(*a*) shows a driving diagram of the buffer purge pump and the wiper member.

In this way, drive force from the planetary gear 59 selectively drives rotation of the cam gear 58 and the pump gear 90 for a total of 605.45 degrees. This selective rotation of the cam gear 58 and the pump gear 90 selectively drives the wiper member 56 and the buffer purge pump 51. FIG. 29(*a*) is a time chart representing this overall operation. As is clearly shown in FIG. 29(*a*), the buffer purge pump 51 does not operate during the wiping operation from position (1) to position (2), so that a suitable head recovery operation can be performed. That is, stopping the buffer purge pump 51 when the ink menisci in the nozzles of the ink jet head 40 are disturbed, such as before wiping and during wiping, prevents ink contaminated with dust and other foreign matter and ink mixed with bubbles from being sucked into the ink chambers of the ink jet head 40. The buffer purge pump 51 is operated after the menisci have been returned to a normal condition by wiping.

FIG. 29(*b*) represents drive of the motor to which the motor shaft gear is connected, when wiping operations are performed. As shown in FIG. 29(*b*) wiping is performed from position (1) to position (2). At position (2), the motor is temporarily stopped and the ink jet head 40 is retracted. Next, the motor is driven at a slow speed to slowly move the wiper member 65 into the position (3) without scattering ink from the tip portion 65*c*. After temporarily stopping the motor in position (3), the motor is again driven at a slow speed to perform wiping. Once the wiping operation is completed, then from position (4) and on the motor speed is slightly increased to operate the purge pump 51. Once operations of the buffer purge pump 51 are completed, speed of the motor is reduced.

FIG. 29(*d*) shows control for driving the motor shaft 5 gear 56 when no wiping operation is performed. FIG. 29(*c*) shows the case when suction purge is performed using the suction pump 63. In the case shown in FIG. 29(*c*), buffer purge pump 51 is driven to operates at a somewhat higher speed so that ink circulation is rapidly performed. Even if the menisci in the nozzles is disturbed by the rapid speed of the buffer purge pump 51, the menisci can be returned to their proper form by performing a wiping operation and a suction purge operation in succession after ink circulation. In the situation represented by FIG. 29(*c*), when driving the pump gear 90, the motor is driven at a higher speed that in the situations represented by FIGS. 29(*b*) and 29(*d*).

The wiper member 65 and the buffer purge pump 51 are driven in the manner described above. Next, the intermittent operation of the wiper member 65 and the buffer purge pump 51 and the reciprocal movement operation of the wiper will be described separately.

Figure 30A:
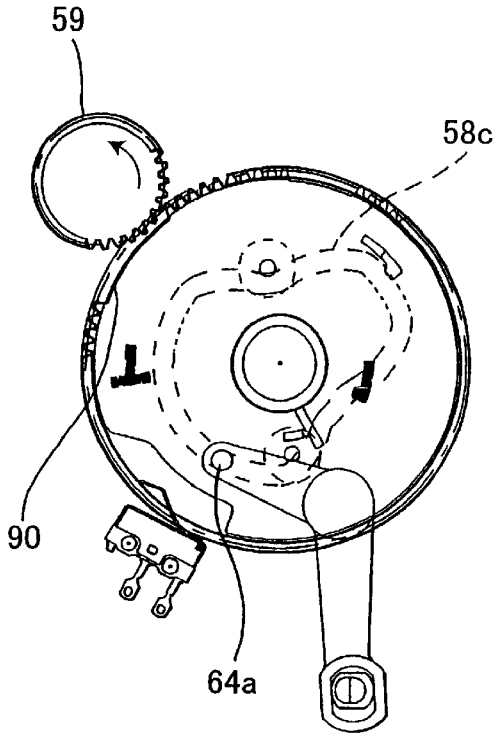
FIGS. 30(*a*) to 30(*c*) are explanatory diagrams illustrating the operations of the cam gear and the wiper member.
Figure 30C:
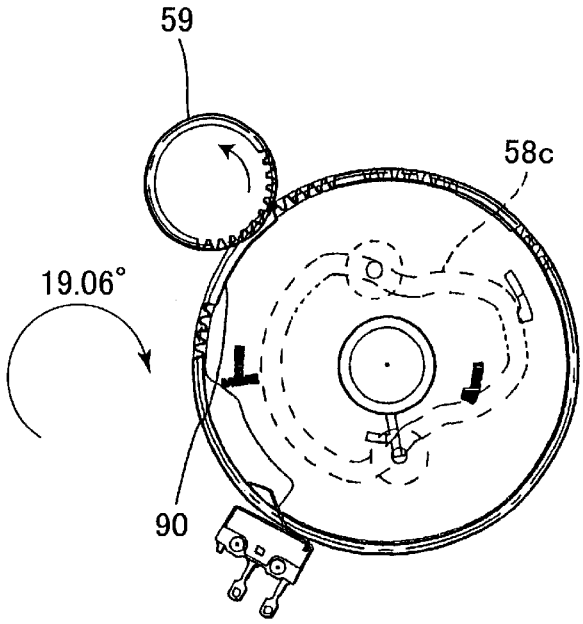
Figure 30B:
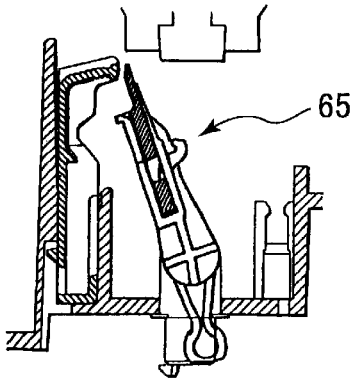

FIGS. 30(*a*) to 32(*d*) show the wiper member 65 and the buffer purge pump 51 during intermittent operation.

As shown in FIG. 30(*a*), only the cam gear 58 is driven in position (0); the pump gear 90 is not driven. In this condition, drive force of the planetary gear 59 drives only the cam gear 58 by 19.06 degrees to position (1) shown in FIG. 29(*c*) in order to detect origin. However, the wiper member 65 remains in the waiting position because the pin 64*a* is engaged in the cam section (a) of the cam groove 58*c*.

Figure 31A:
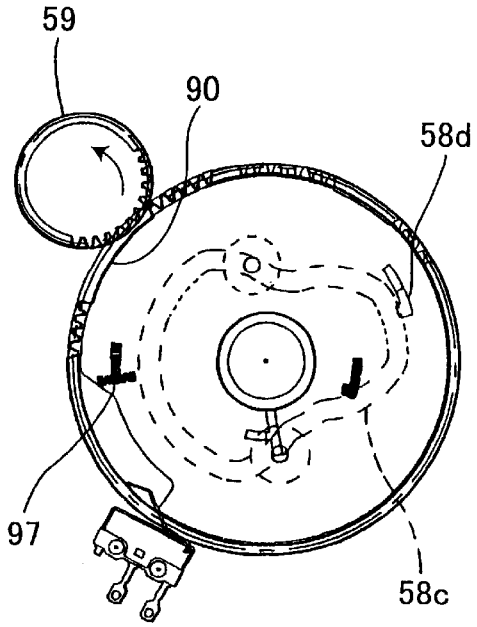
FIGS. 31(*a*) to 31(*c*) are explanatory diagrams illustrating the operations of the cam gear and the wiper member.
Figure 31B:
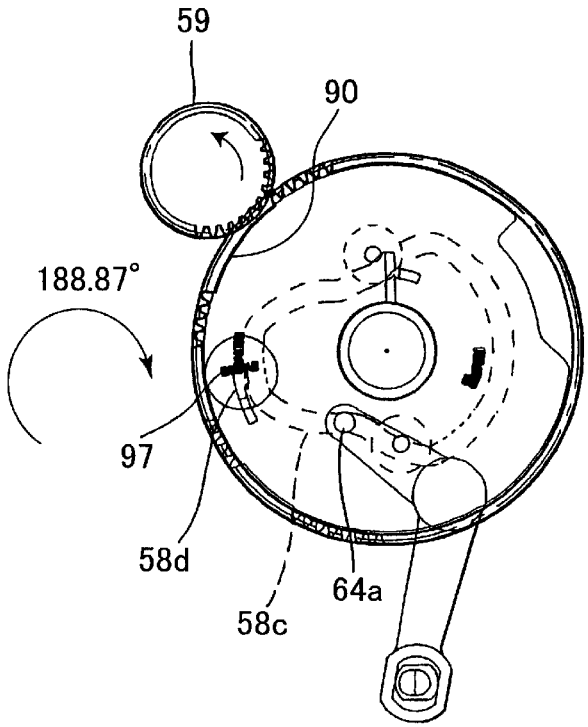
Figure 31C:
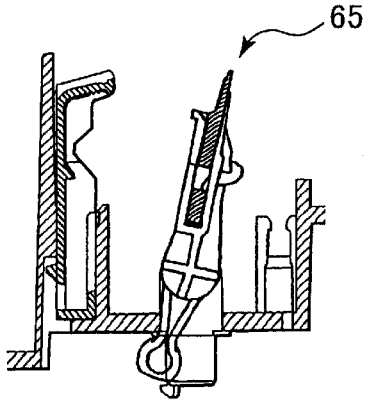
Figure 32A:
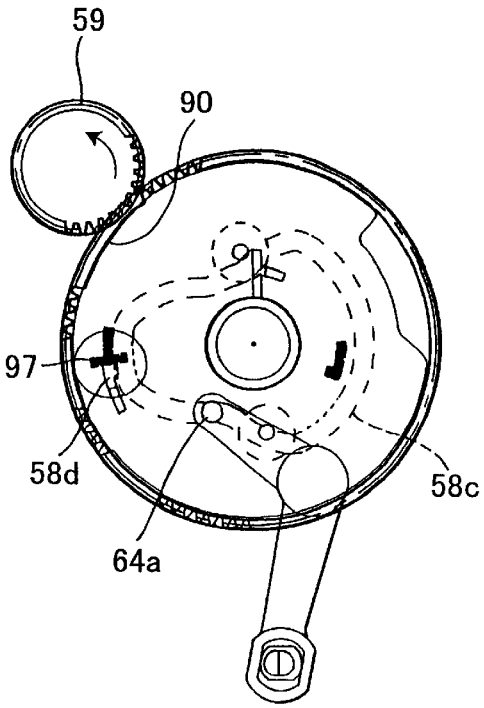
FIGS. 32(*a*) to 32(*d*) are explanatory diagrams illustrating the operations of the cam gear and the wiper member.
Figure 32C:
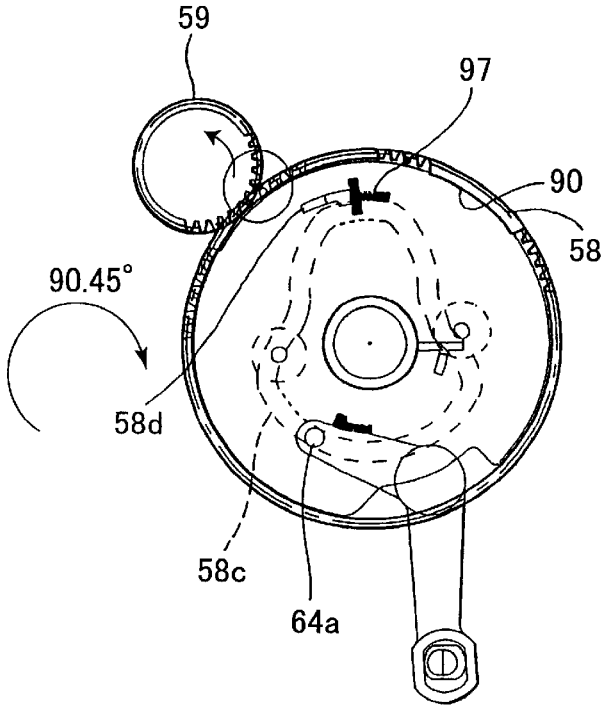
Figure 32B:
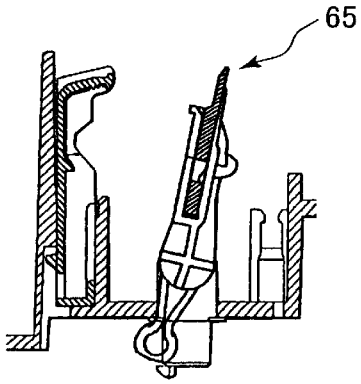
Figure 32D:
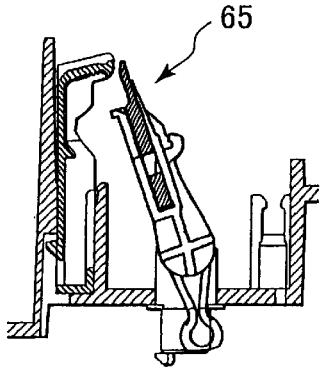
Figure 33A:
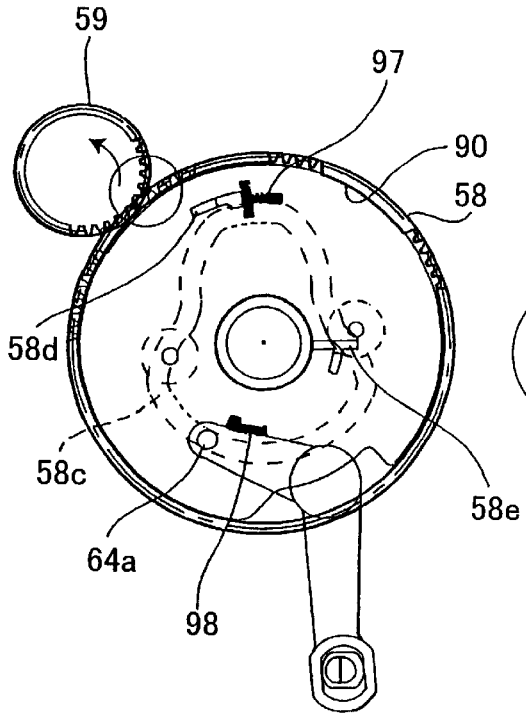
FIGS. 33(*a*) to 33(*d*) are explanatory diagrams illustrating the operations of the cam gear and the wiper member.
Figure 33C:
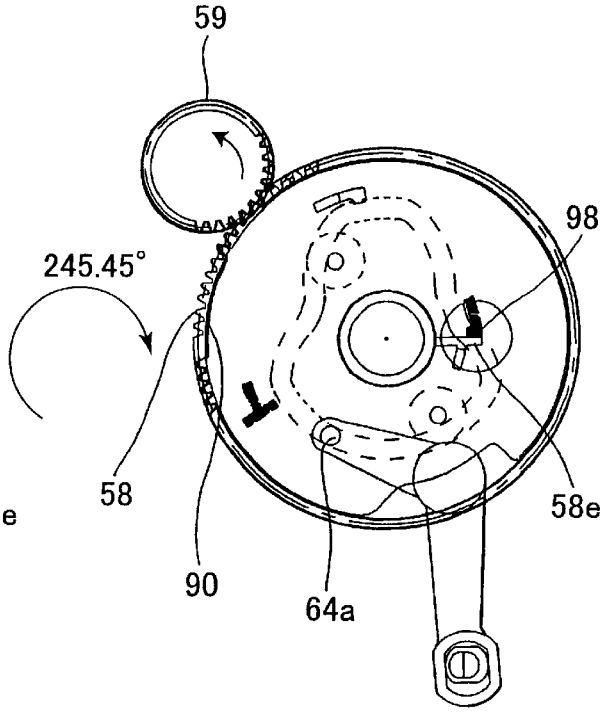
Figure 33B:
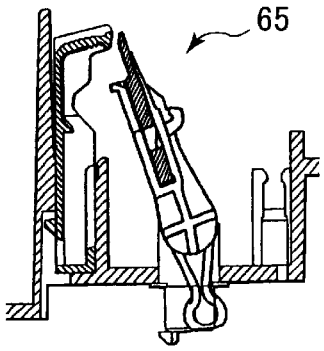
Figure 33D:
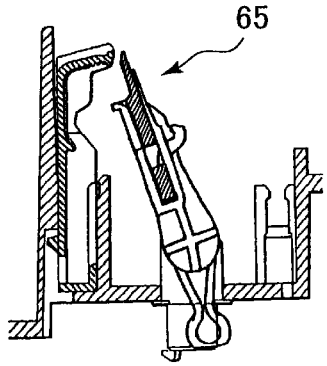
Figure 34A:
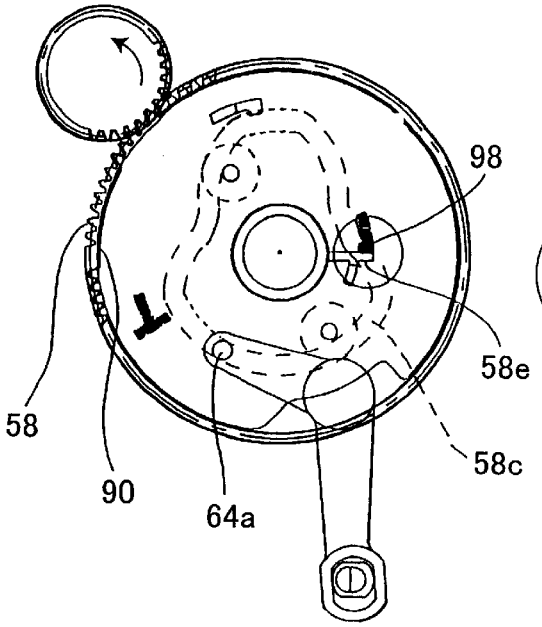
FIGS. 34(*a*) to 34(*d*) are explanatory diagrams illustrating the operations of the cam gear and the wiper member.
Figure 34C:
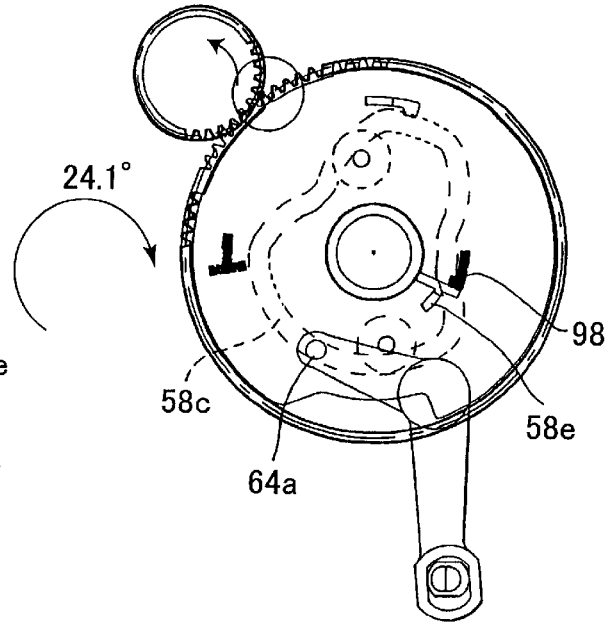
Figure 34B:
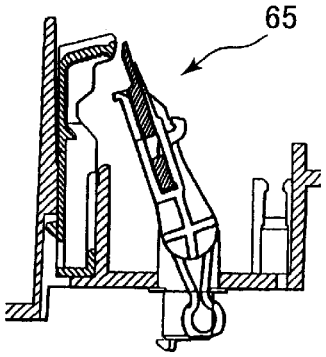
Figure 34D:
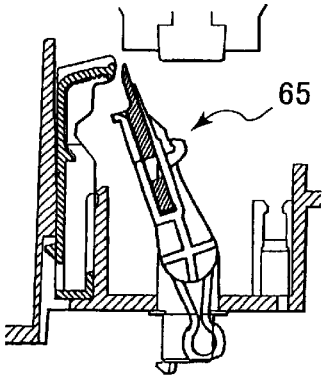
Figure 35A:
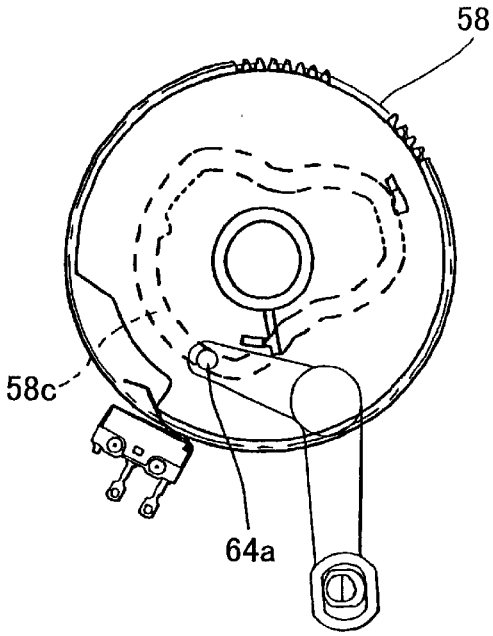
FIGS. 35(*a*) to 35(*d*) are explanatory diagrams illustrating the operations of the cam gear and the wiper member.
Figure 35C:
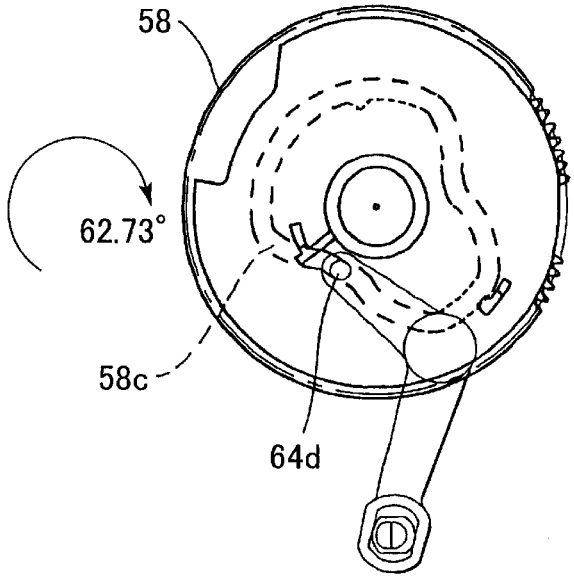
Figure 35B:
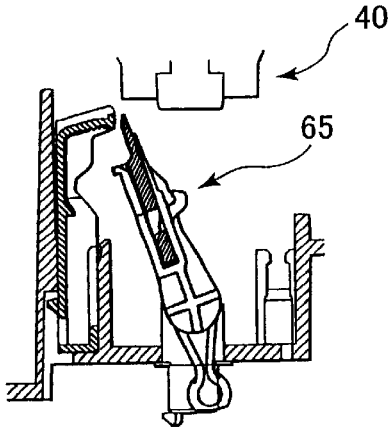
Figure 35D:
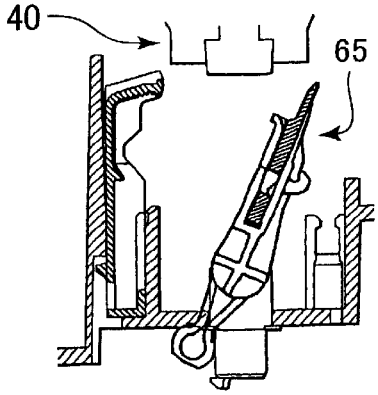
Figure 36A:
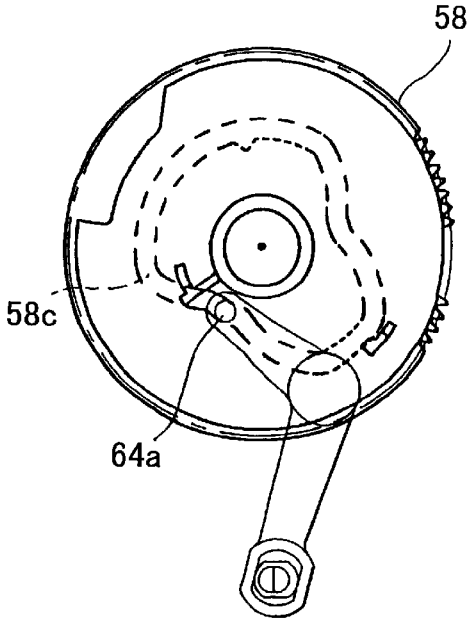
FIGS. 36(*a*) to 36(*d*) are explanatory diagrams illustrating the operations of the cam gear and the wiper member.
Figure 36C:
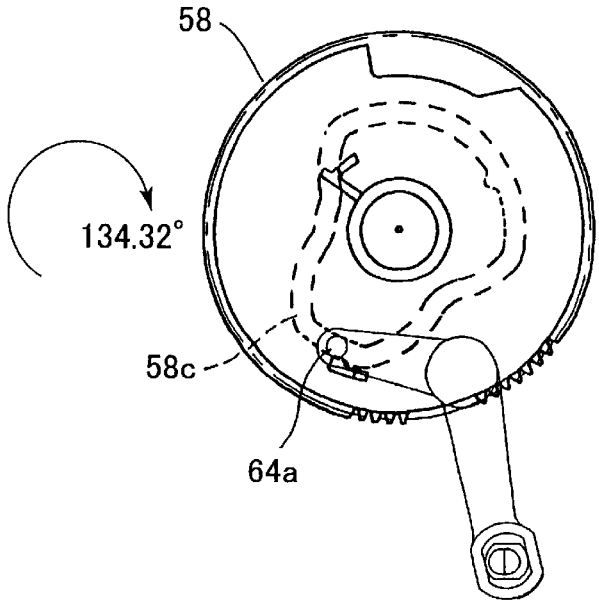
Figure 36B:
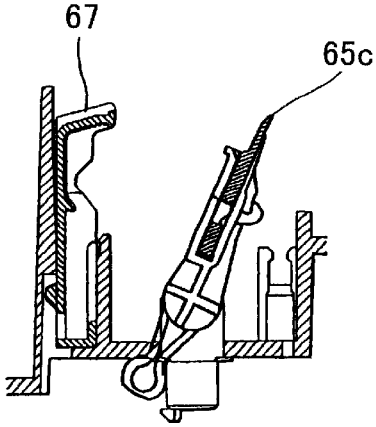
Figure 36D:
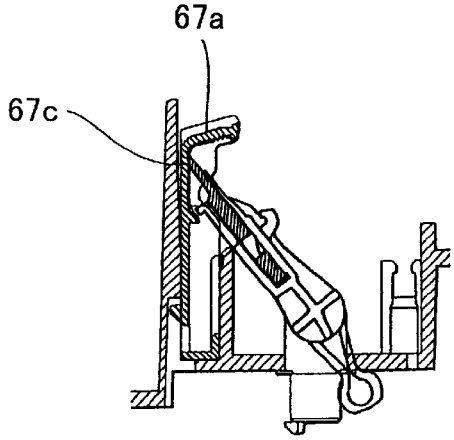
Figure 37A:
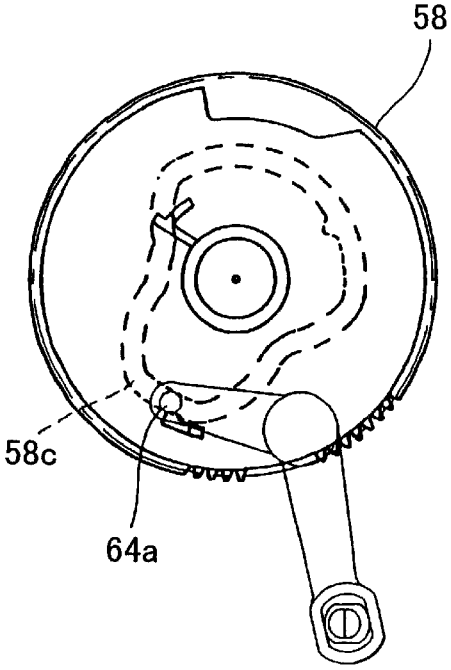
FIGS. 37(*a*) to 37(*d*) are explanatory diagrams illustrating the operations of the cam gear and the wiper member.
Figure 37C:
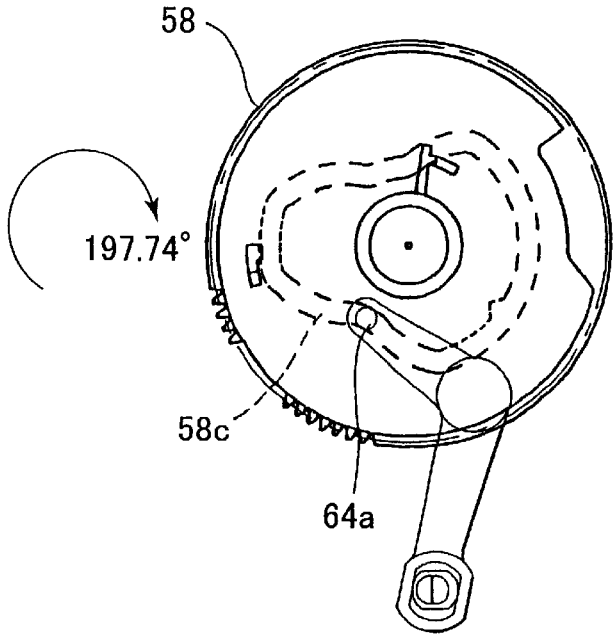
Figure 37B:
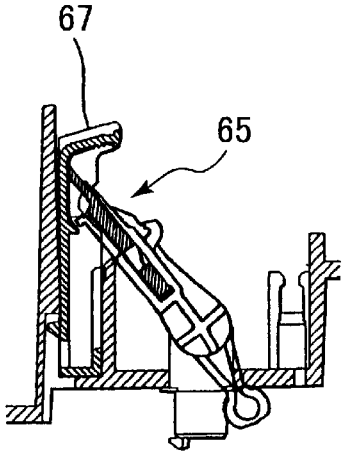
Figure 37D:
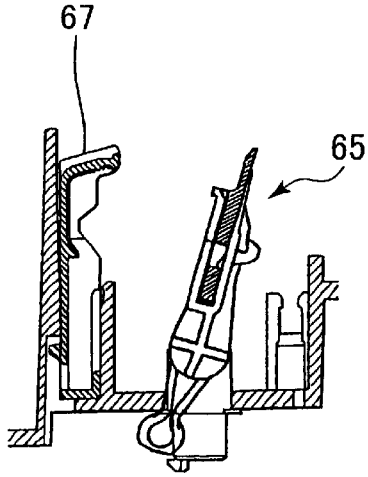
Figure 38A:
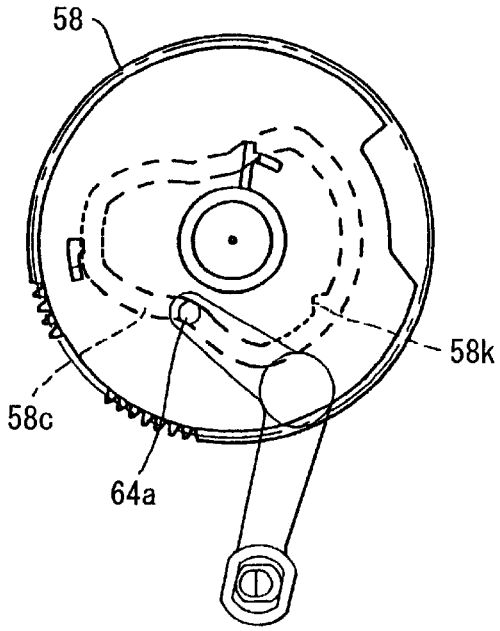
FIGS. 38(*a*) to 38(*d*) are explanatory diagrams illustrating the operations of the cam gear and the wiper member.
Figure 38C:
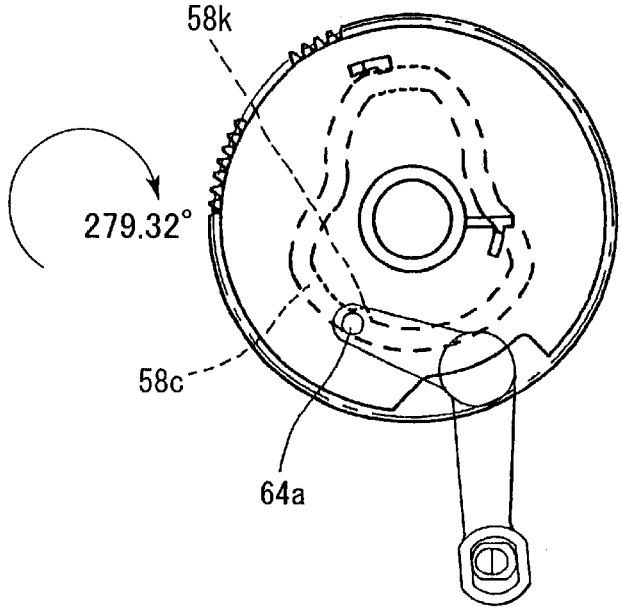
Figure 38B:
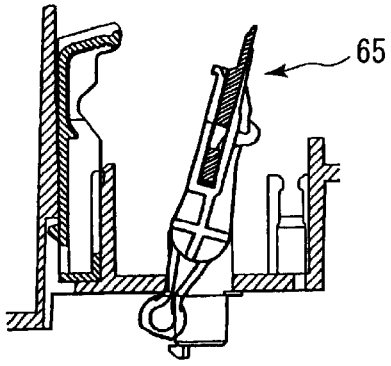
Figure 38D:
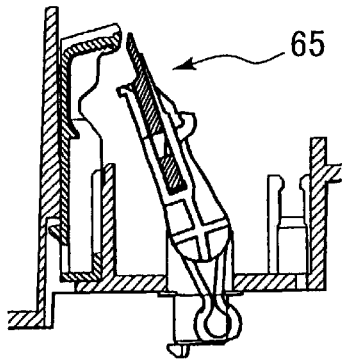
Figure 39A:
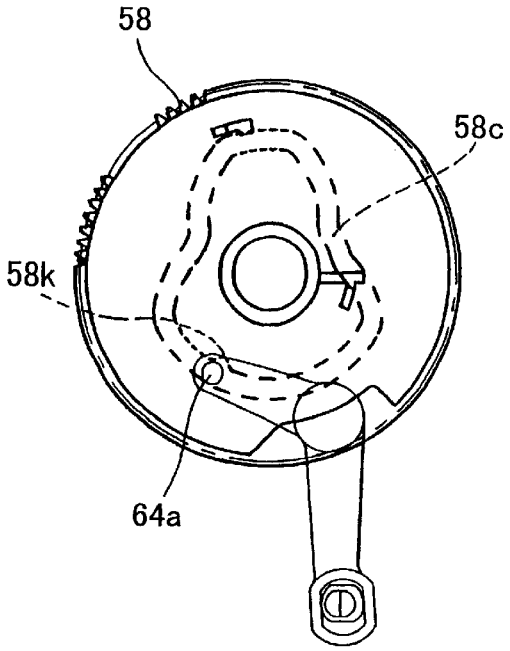
FIGS. 39(*a*) to 39(*d*) are explanatory diagrams illustrating the operations of the cam gear and the wiper member.
Figure 39C:
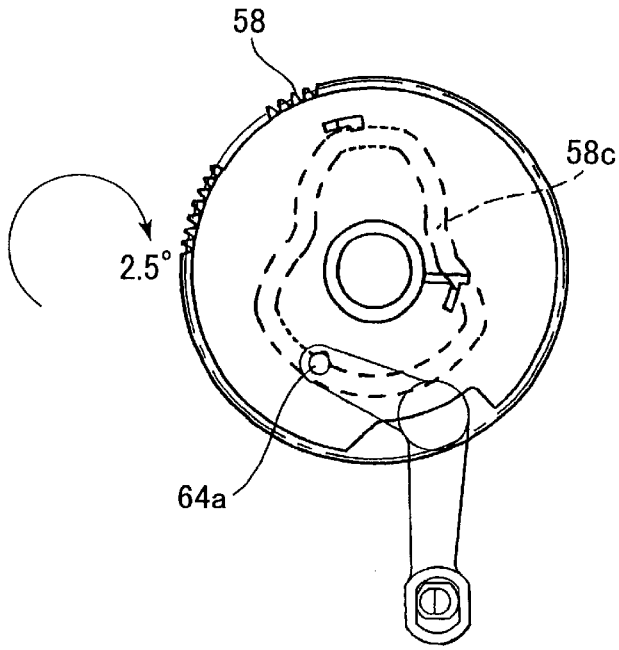
Figure 39B:
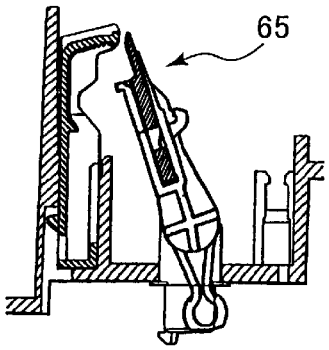
Figure 39D:
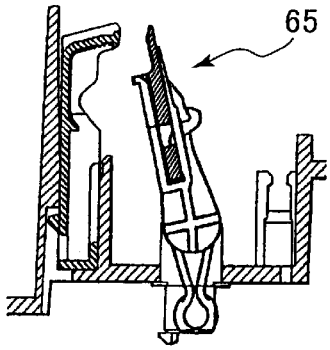

Next, the drive force of the planetary gear 59 drives only the cam gear 58 for 188.87 degrees from position (1) shown in FIG. 31(*a*). As a result, the third protrusion 58*d* of the cam gear 58 abuts against the first protrusion 97 of the pump hear 90 as shown in FIG. 31(*b*).

When the third protrusion 58*d* of the cam gear 58 abuts against the first protrusion 97 of the pump gear 90 as shown in FIGS. 31(*b*) and 32(*a*), the cam gear 58 and the pump gear 90 start rotating together. When drive force of the planetary gear 59 rotates the cam gear 58 and the pump gear 90 by 90.45 degrees from the condition shown in FIG. 32(*a*), then as shown in FIG. 32(*c*) meshing engagement between the cam gear 58 and the planetary gear 59 is released. On the other hand, the pump gear 90 and the planetary gear 59 are in meshing engagement.

When meshing engagement between the cam gear 58 and the planetary gear 59 is released as shown in FIGS. 32(*c*) and 33(*a*), the planetary gear 59 is engaged with only the pump gear 90, so only the pump gear 90 is rotated. When the drive force of the planetary gear 59 rotates only the pump gear 90 by 245.45 degrees from the condition shown in FIG. 32(*a*), then as shown in FIG. 32(*c*) the second protrusion 98 of the pump gear 90 abuts against the fourth protrusion 58*e* of the cam gear 58.

When the second protrusion 98 of the pump gear 90 abuts the fourth protrusion 58*e* of the cam gear 58 as shown in FIGS. 33(*c*) and 34(*a*), then the cam gear 58 and the pump gear 90 rotate together. During this time, the planetary gear 59 and the cam gear 58 are returned to meshing engagement.

When drive force from the planetary gear 59 drives the cam gear 58 and the pump gear 90 by 24.2 degrees from the orientation shown in FIG. 34(*a*), then as shown in FIG. 34(*c*) meshing engagement between the pump gear 90 and the planetary gear 59 will be released and only the cam gear 58 is in a rotatable condition.

Next, reciprocal movement of the wiper member 65 will be described while referring to FIGS. 35(*a*) to 39(*d*). As shown in FIG. 35(*a*), in position (1) the wiper member 65 is in the waiting position because the pin 64*a* is engaged in the cam section (a) of the cam groove 58*c*. The origin is detected as a result. The pin 64*a* passes through the cam section (b) of the cam groove 58*c* while the cam gear 58 rotates from the origin to an angle of 62.73 degrees. As a result, the wiper member 65 moves to the right as viewed in FIGS. 35(*b*) and 35(*d*) from the waiting position to position (2), which is the end point of the first half of the wiper member's reciprocal movement. During this time the wiper member 65 wipes the nozzle surface of the ink jet head 40. As shown in FIG. 29(*b*), the rotational drive of the planetary gear 59 is temporarily stopped and the ink jet head 40 is retracted away from the wiper member 65.

After the ink jet head 40 is retracted, rotation of the cam gear 58 is restarted as shown in FIGS. 36(*a*) and 36(*c*). From when the cam gear 58 is driven to rotate from the origin to an angle of 134.32 degrees, the wiper member 65 moves to the left as viewed in FIG. 36(*d*) from the waiting position as the pin 64*a* moves through the cam section (c) of the cam groove 58*c*. When the pin 64*a* reaches the cam section (d) of the cam groove 58*c*, the wiper member 65 moves to the end point of the second half of its reciprocal movement, that is, the tip portion 65*c* of the wiper member 65 moves to the position where it contacts the inner surface of the back plate 67*c* or the top portion 67*a* of the blade cleaner 67. This is referred to as the wiper cleaning waiting position.

The blade cleaner 67 performs a wiper cleaning operation when rotational drive of the planetary gear 59 drives the cam gear 58 from the wiper cleaning waiting position shown in FIG. 37(*a*) to until the cam gear 58 is rotated to an angle of 197.74 degrees from origin as shown in FIG. 37(*c*). That is, during this time the wiper member 65 moves from the wiper cleaning waiting position to the right as viewed in FIG. 37(*d*) because the pin 64*a* passes through the cam section (f) of the cam groove 58*c*. The wiper member 65 moves to its wiper cleaning completion position in position (4).

When rotational drive of the planetary gear 59 rotates the cam gear 58 from the position (4) shown in FIG. 38(*a*), the wiper member 65 moves to the left as viewed in FIG. 38(*d*) because the pin 64*a* moves through the cam section (g) of the cam groove 58*c*. When the pin 64*a* reaches the cam section (a) of the cam groove 58*c*, the wiper member 65 returns to the waiting position. When the cam gear 58 reaches an angle of 279.32 degrees from origin, then the cam gear 58 is released from meshing engagement with the planetary gear 59, is able to rotate freely, and is not applied with any drive force. Also, the slanted surface of the V-shaped notch 58*k* and the pin 64*a* abut each other with an urging force. This urging force rotates the cam gear 58 slightly so that the notch 58*k* and the pin 64*a* engage each other as shown in FIG. 39(*c*). This engagement prevents the cam gear 58 from rotating in association with rotational drive of the pump gear 90 by, for example, viscosity resistance induced by lubricating oil. This engagement also prevents the cam gear 58, which is in a free rotating condition, from vibrating with vibration of motor drive.

As shown in FIG. 1, the wiper member 65 is oriented perpendicular to the movement direction of the carriage 4. However, the wiper member 65 could be oriented parallel with movement direction of the carriage 4.

Also, the wiper member 65 can be oriented parallel with, at a predetermined angle with, or perpendicular with, alignment direction of nozzles in the ink jet head 40.

Also, reciprocal movement between the ink jet head 40 and the wiper member 65 can be achieved by reversing rotational direction of the platen roller 2 to rotate the cam 62 and move the wiper member 65 in the direction indicated by arrow F4 as shown in FIG. 1. Also, a mechanism for swinging the ink jet head 40 back and forth can be provided on the carriage 4, on which the ink jet head 40 is amounted. The mechanism can move the ink jet head 40 toward and away from the pump unit frame 55.

While the invention has been described in detail with reference to specific embodiments thereof, it would be apparent to those skilled in the art that various changes and modifications may be made therein without departing from the spirit of the invention, the scope of which is defined by the attached claims.

For example, FIG. 1 shows a configuration wherein the ink jet head 40 ejects ink downward at printing sheets P that are transported in a substantially horizontal direction. However, the ink can be ejected in any direction as long as the positional relationship of the buffer tank 20, the manifold 30, and the ink jet head 40 in the vertical direction is maintained.

Also, the ink jet head 40 of FIG. 1 includes a black head 41 for ejecting black ink, a yellow head 42 for ejecting yellow ink, a cyan head 43 for ejecting cyan ink, and a magenta head 44 for ejecting magenta ink. However, the ink jet head 40 can be modified for ejecting three, two, or even one color of ink as long as the general configuration is maintained.

A variety of different printing methods can be applied for the printer. For example, printing can be performed on a line basis by scanning the carriage 4 across the printing sheet P in the directions indicated by arrows F7, F8 to scan the ink jet head 40 across the surface of the paper P, then feeding the paper P by a predetermined amount in the direction indicated by F2 and again scanning the ink jet head 40 in the directions indicated by arrows F7, F8. Alternatively, printing can be performed by first moving the carriage 4 to a predetermined position, then afterward moving only the printing sheet P in the direction F2 during printing while the carriage 4 is maintained stationary.

In the embodiment as described above, a tube pump is used in the suction pump 63. However, a conventionally known cylinder pump can be used in lieu of the tube pump. It is also possible not to provide its own motor to operate the suction pump 63 but to use the motor 88*b* of the ink supply pump 13 as the driving source of the suction pump 63. To this end, the motor 88*b* is switched so as to selectively drive the suction pump 63 and the ink supply pump 13. Or, by providing its own motor to the buffer purge pump 51, the motor of the buffer purge pump 51 may be switched so as to selectively drive the suction pump 63 and the buffer purge pump 51. This switching operation can be achieved by the use of, for example, a planetary gear mechanism that rotates the platen roller 2 when the line feed motor 79 is driven to rotate forward and drive the suction pump 63 when the line feed motor 79 is driven to rotate in reverse.

What is claimed is:

1. An ink jet printer comprising a printer body;

a head unit detachably mounted on said printer body and having an ink head formed with a plurality of ink chambers, said ink head having a nozzle surface formed with a plurality of nozzles fluidly connected to respective ones of said plurality of ink chambers individually;

a pump unit for adjusting an ink condition in said ink head, said pump unit including at least one pump;

a wiper member for wiping said nozzle surface of said ink head;

a motor;

a drive mechanism operatively connecting said motor to said wiper member and at least one pump included in said pump unit, said wiper member and the at least one pump connected to said motor being driven in phase-dependent on rotations of said motor, wherein said drive mechanism comprises:

a transmission gear for transmitting driving force of said motor;

a first gear rotatably disposed to meshingly engage said transmission gear, said first gear being formed with a cam groove for driving said wiper member; and a second gear rotatably disposed to meshingly engage said transmission gear, rotations of said second gear driving said pump; and an adjustment mechanism for adjusting rotational timings of said first gear and said second gear, wherein said first gear and said second gear have a diameter equal to each other and are in concentric with each other, each of said first gear and said second gear having a non-geared portion.

2. The ink jet printer according to claim 1, wherein said adjustment mechanism comprises a first abutment portion formed in said first gear and a second abutment portion formed in said second gear, wherein when said first abutment portion and said second abutment portion are in abutment with each other while one of said first gear and said second gear is stopped and remaining one of said first gear and said second gear is rotated, said one of said first gear and said second gear is urged by and rotated with said remaining one of said first gear and said second gear.

3. The ink jet printer according to claim 1, wherein when said first abutment portion and said second abutment portion are brought into abutment with each other while the non-geared portion of one of said first gear and said second gear faces said transmission gear with said one of said first gear and said second gear being stopped, said one of said first gear and said second gear is urged by and rotated with said remaining one of said first gear and said second gear, and wherein said first abutment portion and said second abutment portion are brought into non-abutment with each other when the non-geared portion of said remaining one of said first gear and said second gear faces said transmission gear.

4. An ink jet printer, comprising a printer body;

a head unit detachably mounted on said printer body and having an ink head formed with a plurality of ink chambers, said ink head having a nozzle surface formed with a plurality of nozzles fluidly connected to respective ones of said plurality of ink chambers individually;

a pump unit for adjusting an ink condition in said ink head, said pump unit including at least one pump;

a wiper member for wiping said nozzle surface of said ink head;

a motor;

a drive mechanism operatively connecting said motor to said wiper member and at least one pump included in said pump unit, said wiper member and the at least one pump connected to said motor being driven in phase-dependent on rotations of said motor;

an ink supply source storing ink;

a first ink channel for supplying the ink in said ink supply source to said head unit; and a second ink channel for feeding back ink in said head unit to said ink supply source, and wherein said pump unit includes a first pump disposed in said second ink channel, said first pump generating a flow of ink from said head unit to said ink supply source when driven and interrupting the flow of ink when stopped.

5. The ink jet printer according to claim 4, herein said first pump is stopped when ink droplets are ejected from any one of said plurality of nozzles.

6. The ink jet printer according to claim 4, wherein said ink supply source comprises an ink cartridge detachably mounted on said ink jet printer body, a third ink channel, and a sub-tank fluidly connected to said ink cartridge through said third ink channel, said sub-tank storing ink supplied from said ink cartridge, and wherein said pump unit further comprises a second pump disposed in said third ink channel, said second pump generating a flow of ink from said ink cartridge to said sub-tank when driven and interrupting the flow of ink when stopped, wherein said first ink channel supplies the ink of said sub-tank to said head unit, and said second ink channel feeds back the ink stored in said head unit to said sub-tank.

7. The ink jet printer according to claim 4, wherein said first pump is not driven during wiping operation of said wiper member.

8. The ink jet printer according to claim 4, further comprising a suction cap movable toward said head unit to hermetically seal said plurality of nozzles, wherein said pump unit further comprises a third pump fluidly connected to said suction cap, said third pump sucking ink in said plurality of ink chambers through said suction cap.

9. The ink jet printer according to claim 8, wherein said first pump is stopped when said third pump sucks ink in said plurality of ink chambers through said suction cap.

10. The ink jet printer according to claim 4, wherein any one of said first pump, said second pump and said third pump comprises a tube pump.

11. An ink jet printer, comprising:

a printer body;

a head unit detachably mounted on said printer body and having an ink head formed with a plurality of ink chambers, said ink head having a nozzle surface formed with a plurality of nozzles fluidly connected to respective ones of said plurality of ink chambers individually;

a pump unit for adjusting an ink condition in said ink head, said pump unit including at least one pump;

a wiper member for wiping said nozzle surface of said ink head;

a motor; and a drive mechanism operatively connecting said motor to said wiper member and at least one pump included in said pump unit, said wiper member and the at least one pump connected to said motor being driven in phase-dependent on rotations of said motor, wherein said drive mechanism moves said wiper member relative to said nozzle surface, and said wiper member comprises:

a blade made from a flexible material and having a tip portion in contact with said nozzle surface, said blade wiping the nozzle surface when said wiper member is moved;

a blade holder for supporting said blade; and a storage mechanism, disposed in a gap formed between said nozzle surface on which said blade wipes and a surface on said blade holder opposite said nozzle surface, for storing ink removed from said nozzle surface by said blade, the ink being stored in a gap between said blade and said blade holder;

wherein said blade holder comprises a pair of support plates, said blade being sandwiched between said pair of support plates, the gap being formed between one of said pair of support plates and said blade, said one of said pair of support plates projecting further toward the tip portion of said blade than remaining one of said pair of support plates.

12. The ink jet printer according to claim 11, wherein said storage mechanism comprises grooves formed in said blade, said grooves shifting the ink clinging to the tip portion of said blade toward the gap.

13. The ink jet printer according to claim 12, wherein said storage mechanism further comprises an ink storing member disposed between said blade and said blade holder.

14. The ink jet printer according to claim 11, wherein said blade resiliently deforms as said blade wipes the nozzle surface, thereby causing the gap to open.

15. An ink jet printer, comprising:

a printer body;

a head unit detachably mounted on said printer body and having an ink head formed with a plurality of ink chambers, said ink head having a nozzle surface formed with a plurality of nozzles fluidly connected to respective ones of said plurality of ink chambers individually;

a pump unit for adjusting an ink condition in said ink head, said pump unit including at least one pump;

a wiper member for wiping said nozzle surface of said ink head;

a motor; and a drive mechanism operatively connecting said motor to said wiper member and at least one pump included in said pump unit, said wiper member and the at least one pump connected to said motor being driven in phase-dependent on rotations of said motor, wherein said drive mechanism moves said wiper member relative to said nozzle surface, and said wiper member comprises:

a blade made from a flexible material and having a tip portion in contact with said nozzle surface, said blade wiping the nozzle surface when said wiper member is moved;

a blade holder for supporting said blade; and a storage mechanism, disposed in a gap formed between said nozzle surface on which said blade wipes and a surface on said blade holder opposite said nozzle surface, for storing ink removed from said nozzle surface by said blade, the ink being stored in a gap between said blade and said blade holder;

wherein said drive mechanism drives said wiper member to make a reciprocal movement and renders said wiper member perform a first operation in which said wiper member moves from a waiting position to an end point in a first half of the reciprocal movement, a second operation in which said wiper member moves from the end point in the first half to an end point of a second half of the reciprocal movement, and a third operation in which said wiper member returns to the waiting position from the end point in the second half, where the waiting position is defined by a position between the start point and the end point in the first half.

16. The ink jet printer according to claim 15, further comprising a head position adjusting mechanism for moving said ink head between a first position and a second position wherein when said ink head is moved to the first position, the tip portion of said blade is brought into abutment with the nozzle surface to collect ink clinging to the nozzle surface of said ink head while said wiper member is moving the first half of the reciprocal movement whereas when said ink head is moved to the second position, the tip portion of said blade is not brought into abutment with the nozzle surface while said wiper member is moving the second half of the reciprocal movement.

17. The ink jet printer according to claim 16, further comprising a cleaning mechanism disposed in the end point in the second half of the reciprocal movement for cleaning said wiper member.

18. The ink jet printer according to claim 17, wherein said cleaning mechanism is in abutment with the tip portion of said blade to thereby clean said blade while said wiper member is performing the third operation.

19. The ink jet printer according to claim 18, wherein said cleaning mechanism comprises a cleaning portion for receiving ink clinging to said blade when said cleaning portion is in abutment with the tip portion of said blade, and an ink removing portion for removing ink received at said cleaning portion.

20. The ink jet printer according to claim 19, wherein said cleaning portion comprises a protrusion, said protrusion confronting the tip portion of said blade when said wiper member is performing the third operation, and wherein said ink removing portion is formed with a slanting surface slanting downward from said protrusion to the end point in the second half of the reciprocal movement.

21. The ink jet printer according to claim 15, wherein said storage mechanism comprises grooves formed in said blade, said grooves shifting the ink clinging to the tip portion of said blade toward the gap.

* * * * *